US009386390B2

(12) United States Patent
Sumioka et al.

(10) Patent No.: US 9,386,390 B2
(45) Date of Patent: Jul. 5, 2016

(54) INFORMATION PROCESSING APPARATUS AND SOUND PROCESSING METHOD

(71) Applicant: FUJITSU LIMITED, Kawasaki-shi, Kanagawa (JP)

(72) Inventors: Motoshi Sumioka, Kawasaki (JP); Kazuo Sasaki, Kobe (JP); Masahide Noda, Kawasaki (JP); Takeshi Ohtani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 39 days.

(21) Appl. No.: 14/220,833

(22) Filed: Mar. 20, 2014

(65) Prior Publication Data

US 2014/0307877 A1 Oct. 16, 2014

(30) Foreign Application Priority Data

Apr. 12, 2013 (JP) ..... 2013-084162

(51) Int. Cl.
*H04R 5/00* (2006.01)
*H04S 7/00* (2006.01)
*H04S 1/00* (2006.01)

(52) U.S. Cl.
CPC . *H04S 7/304* (2013.01); *H04S 1/00* (2013.01); *H04S 2400/11* (2013.01); *H04S 2420/01* (2013.01)

(58) Field of Classification Search
None
See application file for complete search history.

(56) References Cited

U.S. PATENT DOCUMENTS

2003/0052911 A1 3/2003 Cohen-solai
2006/0045294 A1* 3/2006 Smyth ..... H04S 7/304 381/309
2008/0175504 A1* 7/2008 Greene ..... H04N 19/164 382/251
2010/0034404 A1* 2/2010 Dent ..... H04R 5/02 381/310
2010/0316232 A1* 12/2010 Acero ..... H04R 27/00 381/92
2011/0196682 A1* 8/2011 Sandgren ..... H04M 3/56 704/270
2012/0120517 A1* 5/2012 Arai ..... G11B 20/00007 360/8

FOREIGN PATENT DOCUMENTS

| | | |
|---|---|---|
| JP | 2005-503726 | 2/2003 |
| JP | 2011-172250 | 9/2011 |
| JP | 2012-93421 | 5/2012 |
| JP | 2012-238716 | 12/2012 |
| WO | WO 03/026250 | 3/2003 |

OTHER PUBLICATIONS

Kosuke Murai et al. "Possibility of localization sound field by ear-plug type earphones" Technical report of IEICE. EA The Institute of Electronics, Information and Communication Engineers 102(398) Oct. 18, 2002.

* cited by examiner

*Primary Examiner* — Thang Tran
(74) *Attorney, Agent, or Firm* — Staas & Halsey LLP

(57) ABSTRACT

An information processing apparatus includes a forward deciding unit that makes a decision as to a user's forward according to the user's orientation information, a sound generating unit that creates sound data assigned to each of virtual sound sources placed in a plurality of directions preset in advance, a compressing unit that performs compression on the created sound data by the sound generating unit in different ways between the created sound data corresponding to the user's forward obtained by the forward deciding unit and the created sound data corresponding to a direction other than the user's forward, and a communication unit that transmits the compressed sound data by the compressing unit.

9 Claims, 17 Drawing Sheets

FIG. 5A

| TYPE INFORMATION | TIME | ORIENTATION INFORMATION (θ) | ··· |
|---|---|---|---|
| A001 | 16:56:10 | 15° | ··· |
| A001 | 16:56:40 | 60° | ··· |
| ··· | ··· | ··· | ··· |

FIG. 5B

| VIRTUAL SPEAKER ID | POSITION X | POSITION Y |
|---|---|---|
| 1 | 0 | 1 |
| 2 | 0.71 | 0.71 |
| 3 | 1 | 0 |
| 4 | 0.71 | −0.71 |
| 5 | 0 | −1 |
| 6 | −0.71 | −0.71 |
| 7 | −1 | 0 |
| 8 | −0.71 | 0.71 |

FIG. 5C

| FORWARD VIRTUAL SPEAKER |
|---|
| 1 |
| 2 |

FIG. 5D

| VIRTUAL SPEAKER TYPE | CODEC | PARAMETERS |
|---|---|---|
| FORWARD | NON-COMPRESSION | 44 kHz, 16 BITS, 1024 FRAMES |
| OTHERS | SAMPLING | 22 kHz, 16 BITS, 1024 FRAMES |

FIG. 5E

| CODEC INFORMATION |
|---|
| {(1, NON-COMPRESSION, 44 kHz, 16 BITS, 1024 FRAMES),<br>(2, NON-COMPRESSION, 44 kHz, 16 BITS, 1024 FRAMES),<br>(3, SAMPLING, 22 kHz, 16 BITS, 1024 FRAMES), (4, SAMPLING, 22 kHz, 16 BITS, 1024 FRAMES),<br>(5, SAMPLING, 22 kHz, 16 BITS, 1024 FRAMES), (6, SAMPLING, 22 kHz, 16 BITS, 1024 FRAMES),<br>(7, SAMPLING, 22 kHz, 16 BITS, 1024 FRAMES), (8, SAMPLING, 22 kHz, 16 BITS, 1024 FRAMES)} |

INFORMATION PROCESSING APPARATUS AND SOUND PROCESSING METHOD

CROSS-REFERENCE TO RELATED APPLICATION

This application is based upon and claims the benefit of priority of the prior Japanese Patent Application No. 2013-084162, filed on Apr. 12, 2013, the entire contents of which are incorporated herein by reference.

FIELD

The embodiments discussed herein are related to an information processing apparatus, a sound processing method, and a storage medium.

BACKGROUND

An augmented reality (AR) sound technology is being studied in which a sound environment around a certain reference point is compiled with a limited number of virtual speakers (virtual sound sources) and the environment is reproduced at another point. In the AR sound technology, sounds from many directions (eight directions, for example) in the surrounding area are reproduced in another space, so communication bands are used to transfer many sound streams captured in each direction to a reproducing apparatus.

To distribute, for example, content from a server to a user terminal, a technology is used by which a large communication band on a network is assigned to a portion that attracts much attention from the user and a small communication band is assigned to a portion that does not attract so much attention from the user (see Japanese Laid-open Patent Publication No. 2011-172250, for example).

As described above, many communication bands are used to transfer many sounds. Therefore, it is difficult to use the AR sound technology in environments in which bands are limited, such as, for example, wireless local area networks (WLANs) and carrier networks.

To reduce the amount of communication data, lossless compression, lossy compression, or the like may be carried out on sounds to be transferred. In view of compression efficiency, lossy compression, in which sounds are compressed at a high rate, is preferable. In lossy compression, however, sound quality is lowered; if, for example, a high-frequency component, which is a key to determine the vertical direction of a sound source, is lost, perception of sound image localization at the forward of the user (auditor) is deteriorated. This causes a problem in that, for example, a sound at the forward of the users is heard as if it were heard from a position higher than a position assigned as a virtual sound source, making it difficult to obtain appropriate perception of sound image localization at the forward.

SUMMARY

According to an aspect of the embodiments, an information processing apparatus includes a forward deciding unit that makes a decision as to a user's forward according to the user's orientation information a sound generating unit that creates sound data assigned to each of virtual sound sources placed in a plurality of directions preset in advance, a compressing unit that performs compression on the created sound data by the sound generating unit in different ways between the created sound data corresponding to the user's forward obtained by the forward deciding unit and the created sound data corresponding to a direction other than the user's forward, and a communication unit that transmits the compressed sound data by the compressing unit.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIGS. 5A to 5E illustrate examples of various types of data used in the sound processing system;

DESCRIPTION OF EMBODIMENTS

Embodiments will be described with reference to the attached drawings.

Figure 1:
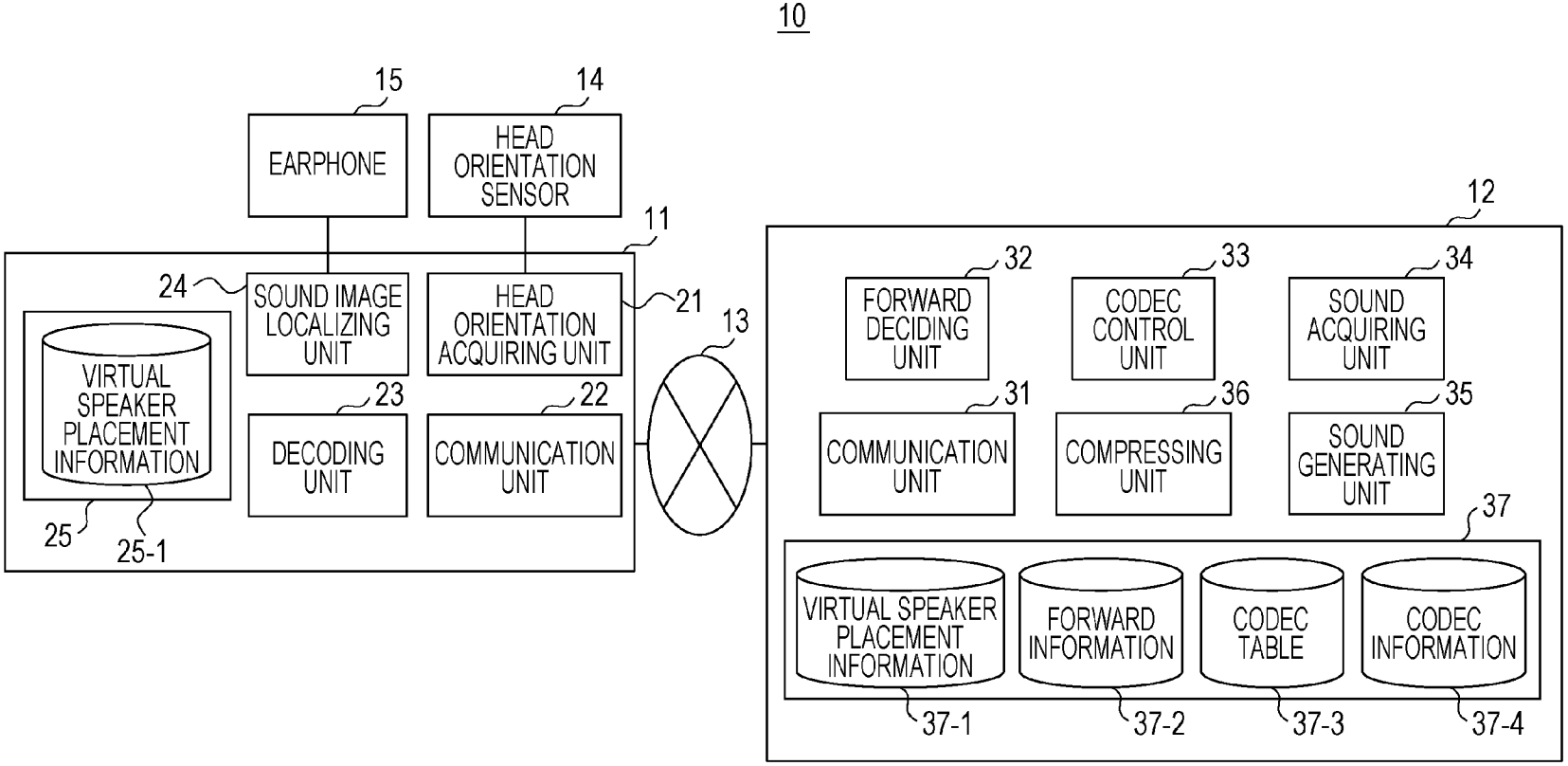
FIG. 1 illustrates an example of the structure of a sound processing system in a first embodiment.

Example of the General Structure of a Sound Processing System in a First Embodiment FIG. 1 illustrates an example of the structure of a sound processing system in a first embodiment. In an example in the first embodiment, sound communication is performed with different sampling rates (sampling frequencies). In the first embodiment, downsampling (conversion to a lower sampling frequency) is used as a data compression function, for example.

The sound processing system 10 in FIG. 1 includes a reproducing apparatus 11, which is an example of a communication terminal, and a supply server 12, which is an example of an information processing apparatus. The reproducing apparatus 11 and supply server 12 are interconnected through a communication network 13 typified by, for example, the Internet, a WLAN, a LAN, and other networks so that transmission and reception of data are possible.

The reproducing apparatus 11 receives sound data transmitted from the supply server 12 and reproduces the received sound data. Although the sound data is, for example, sound data for AR sounds or music data, this is not a limitation. The sound data may be any other acoustic data.

The reproducing apparatus 11 is connected to a head orientation sensor 14, which is an example of an orientation detecting unit that detects the orientation of the head of a user, and to an earphone 15, which is an example of a sound output unit that outputs sounds. The reproducing apparatus 11 acquires orientation information from the head orientation sensor 14 in real time, for example; the orientation information indicates that, for example, the user's front direction and the like. The reproducing apparatus 11 then transmits the acquired orientation information through the communication network 13 to the supply server 12. The reproducing apparatus 11 receives sound data in a plurality of channels corresponding to a plurality of virtual speakers (virtual sound sources), which achieve AR sounds generated by the supply server 12 according to the orientation information, and decodes each received sound data item. The reproducing apparatus 11 compiles the decoded sound data into data for the right ear and data for the left year and outputs sounds from the earphone 15.

The supply server 12 determines the user's forward orientation from the user's orientation information, which is obtained from the reproducing apparatus 11 through the communication network 13. The supply server 12 transmits, to the reproducing apparatus 11, sound data in which sound data corresponding to virtual speakers placed at the forward of the user has information about a high-frequency component. The supply server 12 also transmits, to the reproducing apparatus 11, sound data compressed at a high rate (sound data of low-frequency components), in which information about high-frequency components has been deleted from sound data corresponding to the back of the user (other than the forward).

The forward of the user may be defined to be a range from 0 to 180 degrees on the forward side with respect to a straight line that connects both ears of the user's head in the 360-degree range around the user's head. However, this is not a limitation. For example, the forward of the user may be a range with a prescribed angle on the right and left sides (from −45 degrees to +45 degrees) with respect to the front direction of the user. The back of the user is a range other than the forward described above, but this is not a limitation. In the 360-degree range around the user, a range of a field of view of the user, for example, may be the forward and the remaining range may be the back.

The high-frequency component is a frequency component at frequencies of, for example, about 11 to 12 kHz or higher. The low-frequency component is a frequency component at frequencies of, for example, lower than about 11 to 12 kHz. However, these are not limitations.

The head orientation sensor 14 obtains the orientation of the user's head, for example, in real time, at intervals of a prescribed time, or each time the motion of the user's head is detected. The head orientation sensor 14 may acquire the head's orientation (azimuth) by attaching, for example, an accelerometer or an azimuth sensor, to the user' head. Alternatively, the orientation of the user's head may be acquired from, for example, a subject (for example, a structural body or the like) on an image photographed by, for example, a camera or another photographing unit. However, these are not limitations.

The earphone 15 is attached to, for example, the ears of the user (auditor). The earphone 15 outputs AR sounds, based on the virtual speakers, to the user's right and left ears. The sound output unit is not limited to the earphone 15. For example, a pair of headphones, a surrounding speaker, or the like may be used. However, these are not limitations. The orientation detecting unit and sound output unit may be formed integrally as, for example, the earphone 15 or a pair of headphones.

In the sound processing system 10, the number of reproducing apparatuses 11 and the number of supply servers 12 are not limited to the example in FIG. 1. For example, a plurality of reproducing apparatuses 11 may be connected to a single supply server 12 through the communication network 13. Alternatively, the supply server 12 may be structured through cloud computing in which at least one information processing apparatus is included.

As described above, in the first embodiment, appropriate sounds may be output by achieving both maintenance of sound image localization and data compression in view of, for example, human characteristics and compression characteristics. The human characteristics refer to, for example, that a different frequency characteristic is involved in perception of sound image localization involves for each direction and the use of a high-frequency component is desirable for perception of sound image localization at the forward. The compression characteristics refer to, for example, that reduction in the amount of information in a high-frequency component in, for example, sound compression is effective to maintain sound quality and increase the compression ratio. However, these are not limitations.

Next, examples of the functional structures of the reproducing apparatus 11 and supply server 12 in the sound processing system 10 described above will be described.

Example of the Functional Structure of the Reproducing Apparatus 11

The reproducing apparatus 11 illustrated in FIG. 1 includes a head orientation acquiring unit 21, a communication unit 22, a decoding unit 23, a sound image localizing unit 24, and a storage unit 25. The storage unit 25 stores virtual speaker placement information 25-1.

The head orientation acquiring unit 21 acquires user's head orientation information (azimuth) from the head orientation sensor 14. An output value from the head orientation sensor 14 may be made to correspond to an angle obtained when the head orientation sensor 14 is rotated to the right or left relative to a certain orientation ($\theta$=0 degree), such as, for example, the north. If the head orientation sensor 14 is rotated to the right relative to, for example, the north and the user orients toward the east, the output value $\theta$ of the head orientation sensor 14 is 90 degrees.

The head orientation acquiring unit 21 may acquire the orientation information from the head orientation sensor 14 at intervals of, for example, about 100 ms. Alternatively, the head orientation acquiring unit 21 may acquire the orientation information in response to an acquisition request from the user or when the amount of displacement of the head is a prescribed value or more.

The communication unit 22 receives the orientation information from the head orientation acquiring unit 21 and transmits the received orientation information through the communication network 13 to the supply server 12. The communication unit 22 receives, from the supply server 12 through the communication network 13, sound data (such as compressed digital sounds (eight-channel stereo sounds) or the like), which has been compressed (coded) in a prescribed format in correspondence to a plurality of virtual speakers that achieve AR sounds.

In addition to the sound data, the communication unit 22 may receive, for example, parameters and the like from the supply server 12. For example, the communication unit 22 reads the sound data, a sequence number that identifies the sound data, codec information for the sound data, and the like from packets received from the supply server 12. The codec information is, for example, information that indicates whether sound data corresponding to a plurality of virtual speakers that achieve AR sounds has been compressed or information that indicates a format (such as, for example, an coding method) in which sound data has been compressed. However, the codec information is not limited to this.

The decoding unit 23 decodes data received at the communication unit 22 by using decodec (decoding method) corresponding codec (coding method), parameters, and the like. For each of a preset plurality of virtual speakers (virtual sound sources) 1 to 8, for example, the decoding unit 23 acquires, from the codec information, codec and parameters that match identification information (such as, for example, an ID) about the virtual speaker, and decodes the sound data according to the acquired codec and parameters. The decoding unit 23 decodes sound data compressed a low rate or non-compressed sound data to sound data having a high-frequency component, and also decodes sound data compressed at a high rate to sound data having a low-frequency component (lacking a high-frequency component).

The sound image localizing unit 24 obtains the sound data from the decoding unit 23 and compiles the data according to the user's orientation information acquired from the head orientation acquiring unit 21 and to the virtual speaker placement information 25-1 prestored in the storage unit 25 to perform sound image localization for AR sound reproduction. The sound image localizing unit 24 also outputs sound data for which a sound image has been localized to the earphone 15 as analog sounds (such as, for example, 2-channel stereo sounds) or the like.

The sound image localizing unit 24 convolutes, for example, a head-related transfer function (HRTF) corresponding to a desired direction in sound data (sound source signal). Accordingly, it is possible to obtain the same effect as if a sound were heard from the desired direction.

For each of the plurality of virtual speakers, the sound image localizing unit 24 convolutes a transfer function according to the direction toward the forward of the user to generate right and left sounds (such as, for example, 2-channel stereo sounds) that may be output to the earphone 15. In this case, the sound image localizing unit 24 outputs a high-frequency component to sound data corresponding to a preset virtual speaker corresponding to, for example, the forward of the user. However, this is not a limitation.

The virtual speaker placement information 25-1 stored in the storage unit 25 is placement information about virtual speakers placed in preset many directions to achieve AR sounds. The virtual speaker placement information 25-1 is managed in, for example, the supply server 12 as well, and data synchronization is established between the reproducing apparatus 11 and the supply server 12.

The storage unit 25 stores various types of information (such as, for example, setting information) used by the reproducing apparatus 11 to perform various processing in the first embodiment. However, information stored in the storage unit 25 is not limited to these. For example, head orientation information obtained by the head orientation sensor 14 and sound data and codec information obtained from the supply server 12 may be stored in the storage unit 25.

Each processing by the reproducing apparatus 11 described above may be implemented by, for example, executing a specific application (program) installed in the reproducing apparatus 11.

Example of Functional Structure of the Supply Server 12

The supply server 12 illustrated in FIG. 1 includes a communication unit 31, a forward deciding unit 32, a codec control unit 33, a sound acquiring unit 34, a sound generating unit 35, a compressing unit 36, and a storage unit 37. The storage unit 37 stores virtual speaker placement information 37-1, forward information 37-2, a codec table 37-3, and codec information 37-4.

The communication unit 31 receives user's (auditor's) head orientation information from the reproducing apparatus 11 through the communication network 13. The communication unit 31 also transmits, to the reproducing apparatus 11, sound data (such as, for example, compressed digital sounds (eight-channel stereo sounds)), corresponding to virtual speakers, that has been compressed by, for example, the compressing unit 36 in a prescribed coding method.

Information transmitted by the communication unit 31 to the reproducing apparatus 11 includes, for example, a sequence number, codec information, and sound data (binary strings). However, this is not a limitation. Alternatively, a combination of these information items may be transmitted. For example, the communication unit 31 transmits "1, {(1, non-compressed, 44 kHz, . . . ), . . . , (8, sampling, 22 kHz, . . . )}, {(3R1T0005 . . . ), . . . , (4F1191 . . . )}" as "sequence number, codec information, sound data (binary strings)".

The forward deciding unit 32 determines the user's forward orientation from the orientation information received at the communication unit 31. The forward deciding unit 32 compares the user's orientation information with the virtual speaker placement information 37-1 and selects a prescribed number of virtual speaker (two speakers, for example) closest to the forward of the user (front direction). The forward deciding unit 32 outputs identification information (virtual speaker ID), by which the selected forward virtual speakers is identified, and other information to the codec control unit 33, and stores the identification information in the storage unit 37 as the forward information 37-2.

The codec control unit 33 references the forward information 37-2 and codec table 37-3, and other information stored in the storage unit 37 and acquires codec (coding information and the like) and parameters (coding parameters and the like) corresponding to all virtual speakers (eight virtual channels denoted 1 to 8, for example). For example, the codec control unit 33 outputs, to the compressing unit 36, compression methods (coding methods) in which sound data corresponding to the forward virtual speakers and sound data corresponding to other virtual speakers are coded differently by using codec, parameters, and the like.

For example, the codec control unit 33 decides whether a virtual speaker to be processed is placed at the forward of the user. If the virtual speaker is placed at the forward of the user, the codec control unit 33 acquires codec and parameters for the forward from codec table 37-3 and outputs them to the compressing unit 36. If the virtual speaker is not placed at the forward of the user, the codec control unit 33 acquires codec and parameters for other than the forward from codec table 37-3, and outputs them to the compressing unit 36.

When the front direction of the user is changed, the codec control unit 33 switches the compression methods for virtual speakers 1 to 8 at such a timing that the sound is not discontinued. The codec control unit 33 may also include codec (coding information) and parameters of each virtual speaker (each azimuth) in the codec information 37-4 stored in the storage unit 37.

The sound acquiring unit 34 acquires sound data used to achieve AR sounds in the reproducing apparatus 11. For example, the sound acquiring unit 34 may concurrently acquire sounds from a plurality of microphones placed in many directions in an actual space. Alternatively, the sound acquiring unit 34 may use, for example, an application to acquire sounds output in a virtual space as data obtained from a plurality of virtual speakers placed at prescribed positions in the virtual space.

The sound generating unit 35 creates sound data assigned to each of virtual sound sources placed in a preset plurality of directions in correspondence to the sound data, obtained by the sound acquiring unit 34, from each direction. For example, the sound generating unit 35 creates sound data used to output sound data from a position at which a virtual speaker (virtual sound source) corresponding to sound data, obtained by the sound acquiring unit 34, from one direction is placed.

The compressing unit 36 compresses virtual-speaker-specific sound data obtained from the sound generating unit 35 (in this case, resamples the sound data) according to a combination of codec and parameters controlled by the codec control unit 33. For example, the compressing unit 36 performs compression in different ways between sound data corresponding to the user's forward obtained by the forward deciding unit 32 and sound data corresponding to other than the user's forward.

If, for example, the compressing unit 36 acquires sound data corresponding to a plurality of virtual speakers (for examples, virtual speakers denoted 1 to 8) from the sound generating unit 35, the compressing unit 36 references codec and parameters that match the IDs of the virtual speakers in the codec information 37-4. The compressing unit 36 then compresses each sound data item according to the reference parameters and the like.

For example, the compressing unit 36 performs low compression, in which the reproducing apparatus 11 may restore the high-frequency component, on the sound data corresponding to the user's forward, and also performs high compression, in which the reproducing apparatus 11 may restore only the low-frequency component, on the sound data corresponding to other than the user's forward. The compressing unit 36 may not perform compression on sound data of the virtual speakers corresponding to the user's forward to leave the high-frequency component, leaving the sound data uncompressed.

The compressing unit 36 may use, for example, pulse code modulation (PCM) as a method of compressing original sound data. The compressing unit 36 may also use Free Lossless Audio Codec (FLAC) or another format in lossless compression. In addition, the compressing unit 36 may use G.711, G.722.1, G.719, or the like in lossy compression for sounds and may use Moving Picture Experts Group Audio Layer-3 (MP3), Advanced Audio Coding (AAC), or the like for lossy compression for music. The compressing unit 36 uses at least one compression method described above under control by the codec control unit 33, but compression methods are not limited to these methods.

The communication unit 31 transmits the sound data, compressed by the compressing unit 36, for virtual speakers to the reproducing apparatus 11 in correspondence to the codec information 37-4 and the like. For example, the communication unit 31 acquires sound data compressed in a prescribed coding method or non-compressed sound data from the compressing unit 36, includes a sequence number, codec information, and the like in a packet, and sets sound data areas for all channels of the sound data according to the codec. The communication unit 31 then uses the set areas to transmit sound data in all channels through the communication network 13 to the reproducing apparatus 11.

The storage unit 37 stores at least one of the virtual speaker placement information 37-1, forward information 37-2, codec table 37-3, and codec information 37-4, described above. Although the storage unit 37 stores various types of information (such as, for example, setting information) used by the supply server 12 to perform processing in the first embodiment, stored information is not limited to these information items. For example, the storage unit 37 may store identification information that identifies a user who uses the reproducing apparatus 11, orientation information obtained from the reproducing apparatus 11, and other information.

In the first embodiment, due to processing by the supply server 12 described above, compressed sound data may be transmitted while perception of localization is maintained. Each processing by the supply server 12 may be implemented by, for example, executing a specific application (program) installed in the supply server 12.

The reproducing apparatus 11 described above is, for example, a personal computer (PC), but this is not a limitation. For example, the reproducing apparatus 11 may be, for example, a tablet terminal, a smart phone, or another communication terminal. Alternatively, the reproducing apparatus 11 may be a music reproducing apparatus, a game unit, or the like. The supply server 12 is, for example, a PC or server, but this is not a limitation.

Example of the Hardware Structure of the Reproducing Apparatus 11

Figure 2:
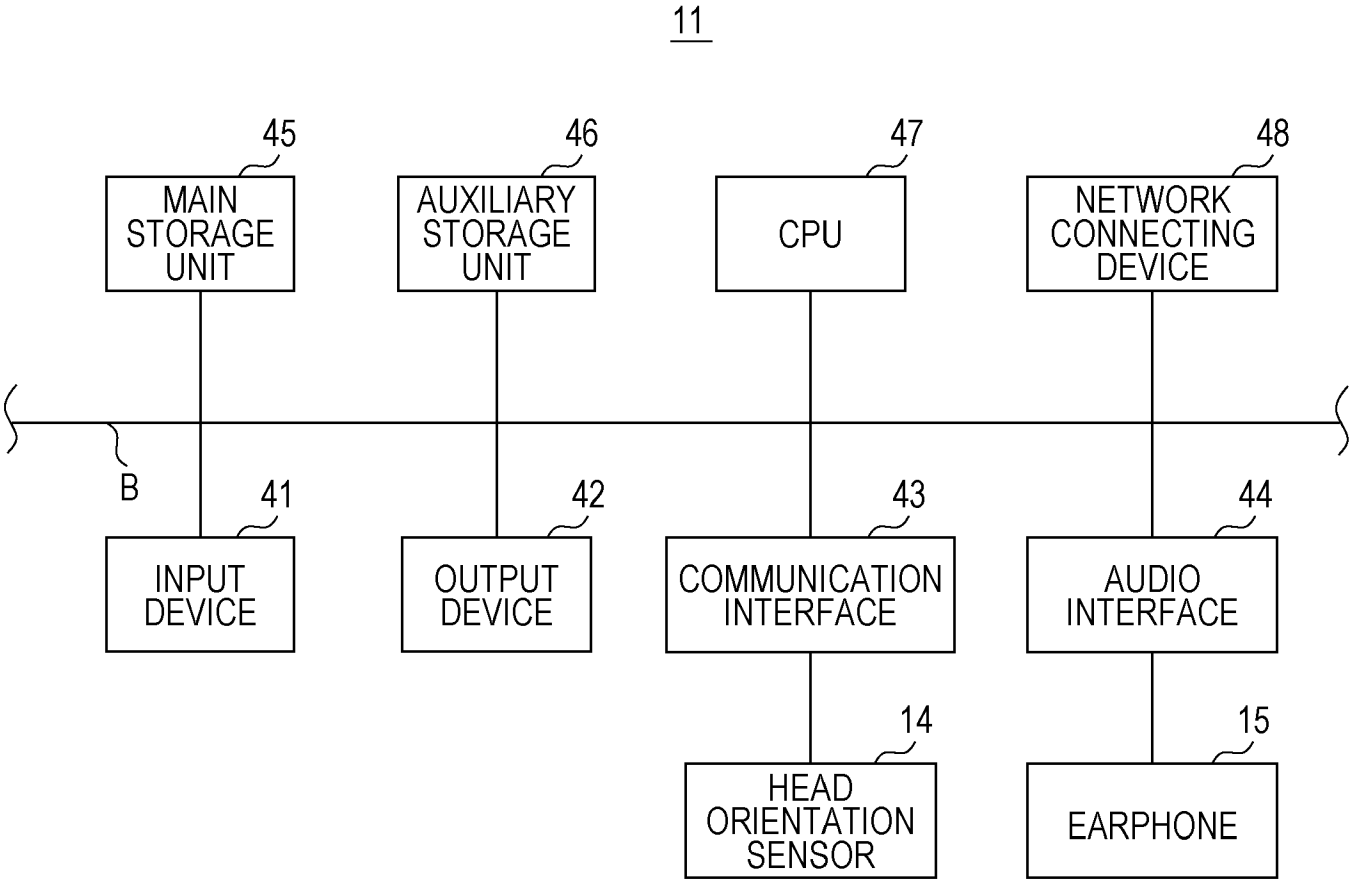
FIG. 2 illustrates an example of the hardware structure of a reproducing apparatus.

FIG. 2 illustrates an example of the hardware structure of a reproducing apparatus. The reproducing apparatus 11 in FIG. 2 includes an input device 41, an output device 42, a communication interface 43, an audio interface 44, a main storage unit 45, an auxiliary storage unit 46, a central processing unit (CPU) 47, and a network connecting device 48, which are mutually connected by a system bus B.

The input device 41 receives a command to execute a program, various types of manipulation information items, information used to start software, and other inputs from a user on the reproducing apparatus 11. The input device 41 is, for example, a touch panel and prescribed manipulation keys, and the like. A signal created in response to a manipulation made on the input device 41 is sent to the CPU 47.

The output device 42 has a display on which various types of windows, data, and the like that are used to manipulate the reproducing apparatus 11 in the first embodiment are displayed. A program execution progress and execution results may be displayed on the display by a control program in the CPU 47.

The communication interface 43 acquires orientation information about the user's head, which is obtained by the head orientation sensor 14 described above. The audio interface 44 converts a digital sound sent from the CPU 47 to an analog sound, amplifies the converted analog sound, and outputs the amplified analog sound to the earphone 15 described above or the like.

The main storage unit 45 temporarily stores at least part of an operating system (OS) program and an application program that are executed by the CPU 47. The main storage unit 45 also stores various types of data used by the CPU 47 to perform processing. The main storage unit 45 is, for example, a read-only memory (ROM), a random-access memory (RAM), or the like.

The auxiliary storage unit 46 magnetically writes and read data to and from a built-in magnetic disk. The auxiliary storage unit 46 stores the OS program, application programs, and various types of data. The auxiliary storage unit 46 is, for example, a flash memory, a hard disk drive (HDD), a solid-state drive (SSD), or another storage unit. The main storage unit 45 and auxiliary storage unit 46 correspond to, for example, the storage unit 25 described above.

The CPU 47 may implement desired processing by controlling processing, in the entire computer of the reproducing apparatus 11, that includes various types of calculations and data inputs and outputs to and from various hardware components, according to control programs such as the OS and executable programs stored in the main storage unit 45. The CPU 47 may obtain various types of information and the like that are used during program execution from, for example, the auxiliary storage unit 46. The CPU 47 may also store execution results and like in the auxiliary storage unit 46.

For example, the CPU 47 executes a program (such as a sound processing program) installed in the auxiliary storage unit 46 in response to, for example, a program execution command entered from, for example, the input device 41 to perform processing corresponding to the program in the main storage unit 45.

By executing a sound processing program, for example, the CPU 47 causes the head orientation acquiring unit 21 described above to acquire a head orientation, the communication unit 22 to send and receive various types of data, the decoding unit 23 to perform decoding, and the sound image localizing unit 24 to perform sound image localization, and performs other processing. However, processing performed by the CPU 47 is not limited to this. Results of processing by the CPU 47 are stored in the auxiliary storage unit 46 if desirable.

When connected to, for example, the communication network 13, the network connecting device 48 acquires an executable program, software, setting information, and the like from, for example, an external apparatus (such as, for example, the supply server 12) connected to the communication network 13, according to control signals from the CPU 47. The network connecting device 48 may provide execution results obtained as a result of program execution or the executable program itself in the first embodiment to the external apparatus or the like. The network connecting device 48 may include a communication function that enables communication based on, for example, Wi-Fi (registered trademark), Bluetooth (registered trademark), or the like. The network connecting device 48 may include a call function that enables a call between the network connecting device 48 and a telephone terminal.

Due to a hardware structure as described above, the sound processing in the first embodiment may be executed. In the first embodiment, when an executable program (sound processing program) that may cause a computer to execute various functions is installed in, for example, a communication terminal or the like, the sound processing in the first embodiment may be easily implemented.

Furthermore, the network connecting device 48 may include a communication function that enables communication based on, for example, Wi-Fi (registered trademark), Bluetooth (registered trademark), or the like. The network connecting device 48 may include a call function that enables a call between the network connecting device 48 and a telephone terminal.

Example of the Hardware Structure of the Supply Server 12

Figure 3:
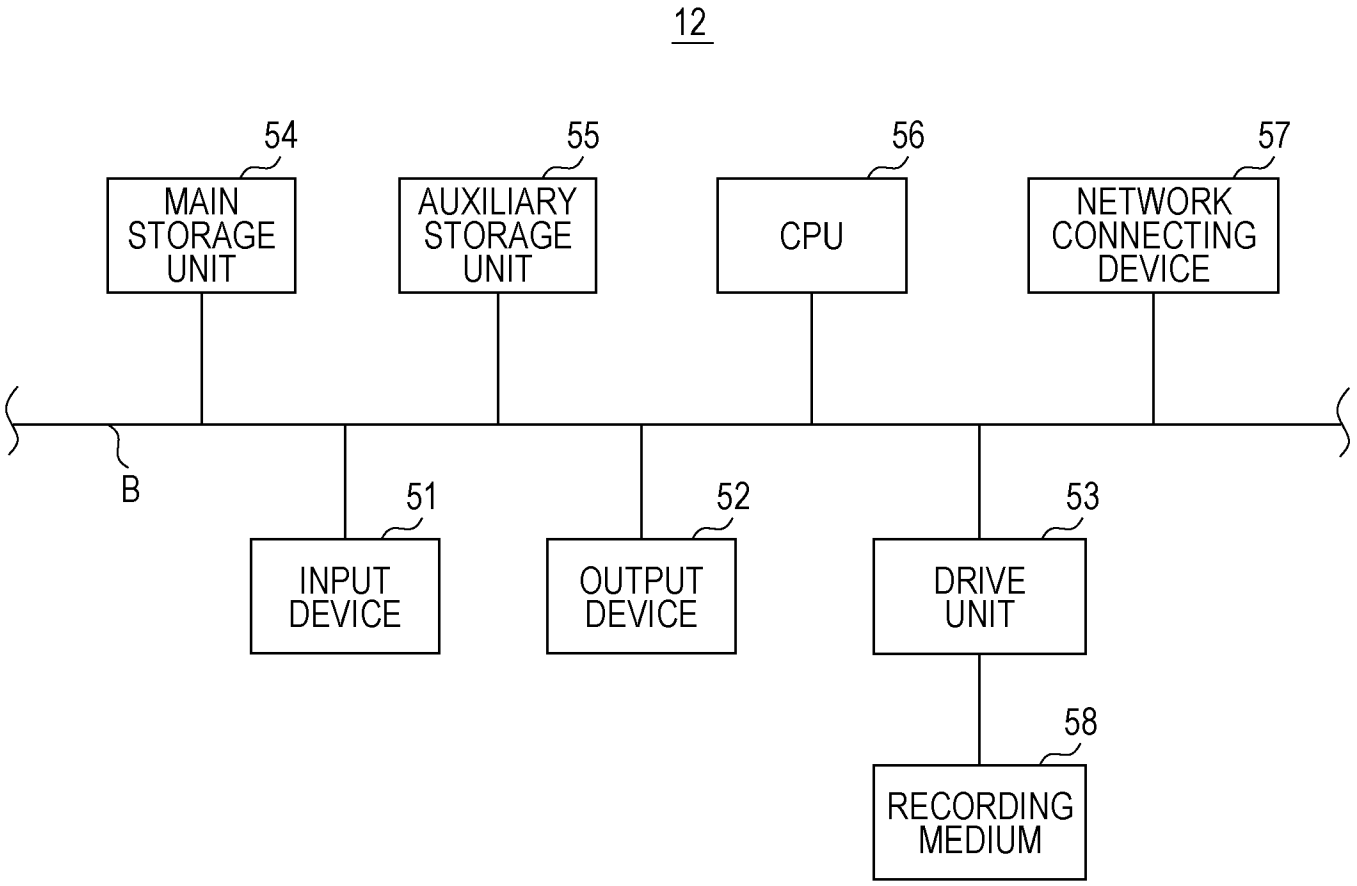
FIG. 3 illustrates an example of the hardware structure of a supply server.

The supply server 12 illustrated in FIG. 3 includes an input device 51, an output device 52, a drive unit 53, a main storage unit 54, an auxiliary storage unit 55, a CPU 56, and a network connecting unit 57, which are mutually connected by the system bus B.

The input device 51 receives a command to execute a program, various types of manipulation information items, information used to start software, and other inputs from a user such as a manger of the supply server 12. The input device 51 includes a keyboard and a pointing device such as a mouse or the like, which are manipulated by the user of the supply server 12 or another person, and also includes a sound input device such as a microphone.

The output device 52 has a display on which various types of windows used to manipulate the supply server 12 in the first embodiment, data, and the like are displayed. A program execution progress and execution results may be displayed on the display by a control program in the CPU 56.

Executable programs to be installed in the main body of a computer such as, for example, the supply server 12 are provided from, for example, a portable recording medium 58 such as a universal serial bus (USB) memory, a compact disc-read-only memory (CD-ROM), or a digital versatile disc (DVD). The recording medium 58 on which executable programs have been recorded may be set in the drive unit 53. The executable programs recorded on the recording medium 58 are installed from the recording medium 58 in the auxiliary storage unit 55 through the drive unit 53 according to control signals from the CPU 56.

The main storage unit 54 temporarily stores at least part of an OS program and an application program that are executed by the CPU 56. The main storage unit 54 also stores various types of data used by the CPU 56 to perform processing. The main storage unit 54 is a ROM, a RAM or the like.

The auxiliary storage unit 55 stores executable programs in the first embodiment, control programs installed in the computer, and the like according to control signals from the CPU 56, and performs input and output operations if desirable. The auxiliary storage unit 55 may read out desirable information from the stored information or may write desirable information according to control signals from the CPU 56. The auxiliary storage unit 55 is, for example, an HDD, an SSD, or another storage unit. The main storage unit 54 and auxiliary storage unit 55 correspond to, for example, the storage unit 37 described above.

The CPU 56 may implement desired processing by controlling processing, in the entire computer of the supply server 12, that includes various types of calculations and data inputs and outputs to and from various hardware components, according to control programs such as the OS and executable programs stored in the main storage unit 54. The CPU 56 may obtain various types of information and the like that are used during program execution from, for example, the auxiliary storage unit 55. The CPU 56 may also store execution results and like in the auxiliary storage unit 55.

For example, the CPU 56 executes a program (such as a sound processing program) installed in the auxiliary storage unit 55 in response to, for example, a program execution command entered from, for example, the input device 51 to perform processing corresponding to the program in the main storage unit 54.

By executing a sound processing program, for example, the CPU 56 causes the forward deciding unit 32 described above to make a decision as to the forward, the codec control unit 33 to perform codec control, and the sound acquiring unit 34 to acquire sound data, and performs other processing. In addition, the CPU 56 causes the sound generating unit 35 to generate sound data intended for the virtual speakers and the compressing unit 36 to compress the sound data. However, processing performed by the CPU 56 is not limited to this. Results of processing by the CPU 56 are stored in the auxiliary storage unit 55 if desirable.

When connected to, for example, the communication network 13, the network connecting device 57 acquires an executable program, software, setting information, and the like from, for example, an external apparatus connected to the communication network 13, according to control signals from the CPU 56. The network connecting unit 57 may provide execution results obtained as a result of program execution or the executable program itself in the first embodiment to the external apparatus or the like.

Due to a hardware structure as described above, the sound processing in the first embodiment may be executed. In the first embodiment, when an executable program (sound processing program) that may cause a computer to execute various functions is installed in, for example, a general-purpose PC or the like, the sound processing in the first embodiment may be easily implemented.

Example of Processing in the Sound Processing System 10

Figure 4:
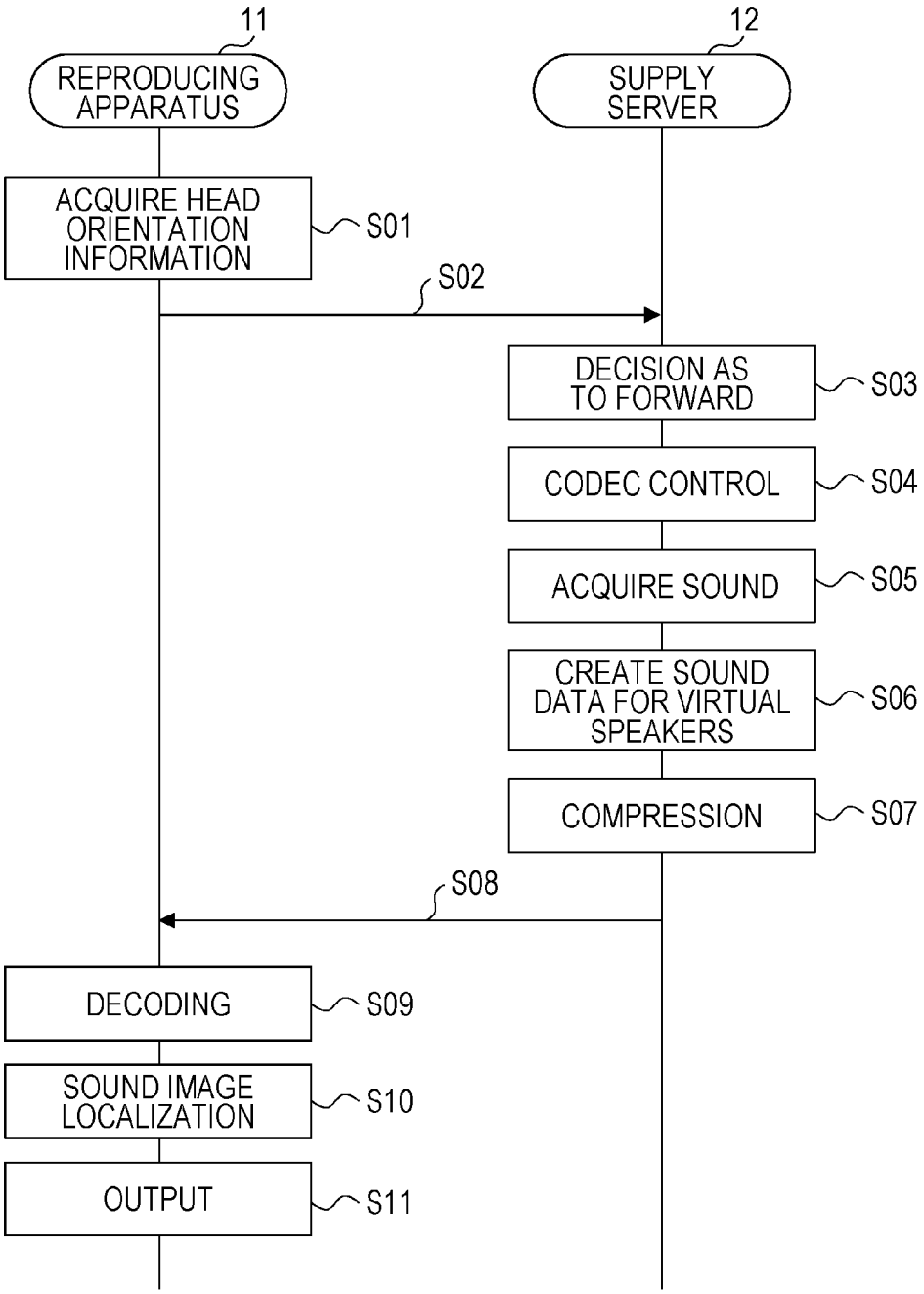
FIG. 4 is a sequence diagram illustrating an example of processing performed by the sound processing system.

Next, an example of sound communication processing in the sound processing system 10 described above will be described with reference to a sequence diagram. FIG. 4 is a sequence diagram illustrating an example of processing performed by a sound processing system. In the example in FIG. 4, the reproducing apparatus 11 and supply server 12 described above are used.

In the example in FIG. 4, the head orientation acquiring unit 21 in the reproducing apparatus 11 acquires user's head orientation information from, for example, the head orientation sensor 14 (S01). The communication unit 22 in the reproducing apparatus 11 transmits the head orientation information acquired in processing in S01 to the supply server 12 (S02).

The forward deciding unit 32 in the supply server 12 makes a decision as to the forward of the user according to the head orientation information acquired in the processing in S02 and then transmitted from the reproducing apparatus 11 and to the virtual speaker placement information 37-1 prestored in the storage unit 37 and then selects a virtual speaker corresponding to the forward direction (S03).

Next, according to the result of the decision as to the user's orientation to the forward, the codec control unit 33 in the supply server 12 performs codec control to compress sound data corresponding to each virtual speaker (S04). Next, the sound acquiring unit 34 in the supply server 12 acquires sound data from which sounds to be output from a plurality of virtual speakers corresponding to AR sounds achieved by the reproducing apparatus 11 are generated (S05). Next, the sound generating unit 35 in the supply server 12 creates sound data intended for the virtual speakers from the sound data acquired in the processing in S05 (S06).

Next, the compressing unit 36 in the supply server 12 compresses (codes) sound data by compression methods corresponding to the virtual speakers, according to the codec table 37-3 stored in the storage unit 37 (S07). In the processing in S07, sound data having a high-frequency component, for example, is compressed (undergoes low compression or non-compression) in, for example, a channel corresponding to the forward decided in the above processing in S03, and high-compression at a degree in which, for example, high-frequency components are not restored is performed for channels for other than the forward.

The communication unit 31 in the supply server 12 transmits sound data compressed in the processing in S07, codec information, and the like through the communication network 13 to the reproducing apparatus 11 in the form of packet data or the like (S08).

The communication unit 22 in the reproducing apparatus 11 receives the information transmitted from the supply server 12 in the processing in S08. The decoding unit 23 in the reproducing apparatus 11 retrieves the sound data compressed in the processing in S07 from the received information, and decodes the retrieved sound data by a decoding method corresponding to the codec information (S09). In the processing in S09, appropriate decoding may be performed by using, for example, channel-specific codec information transmitted together with the sound data in the processing in S08.

The sound image localizing unit 24 in the reproducing apparatus 11 compiles channel-specific sound data decoded in the processing in S09 into data for the right ear and data for left ear, performs sound image localization processing on the compiled data so that AR sounds are output from the earphone 15 (S10), and outputs the processed data to, for example, the earphone 15 (S11).

The above processing is repeated until there is no more sound reproduced from the reproducing apparatus 11 or the sound communication processing in the first embodiment is terminated in response to a command from the user. Accordingly, sound data that has undergone sound image localization in correspondence to real-time changes of the user's head orientation may be provided to the user.

Examples of Various Types of Data and Other Examples

Next, examples of various types of data in the sound processing system 10 described above and other examples will be described with reference to FIGS. 5A to 5E and FIG. 6. FIGS. 5A to 5E illustrate examples of various types of data; FIG. 5A illustrates an example of head orientation information, FIG. 5B illustrates an example of the virtual speaker placement information 25-1 or 37-1, FIG. 5C illustrates an example of the forward information 37-2, FIG. 5D illustrates an example of the codec table 37-3, and FIG. 5E illustrates an example of codec information.

Items in the head orientation information indicated in FIG. 5A include, for example, identification information, time, and orientation information. However, the head orientation information is not limited to these items. The identification information in FIG. 5A is used by the supply server 12 to identify the reproducing apparatus 11. The time in FIG. 5A is a time at which the user's head orientation information was acquired from the head orientation sensor 14. The orientation information in FIG. 5A is user's head orientation information acquired from the head orientation sensor 14. In the example in FIG. 5A, an angle relative to the forward of the user (right in front), but this is not a limitation.

Items in the virtual speaker placement information 25-1 or 37-1 indicated in FIG. 5B include, for example, a virtual speaker ID, position x, and position y. However, the virtual speaker placement information 25-1 or 37-1 is not limited to these items. The virtual speaker placement information 25-1 or 37-1 may be angle information. In the example in FIG. 5B, placement information about eight virtual speakers with IDs of 1 to 8 is set by using their coordinates. However, this is not a limitation. An angle at which each virtual speaker is attached may be set.

Figure 6:
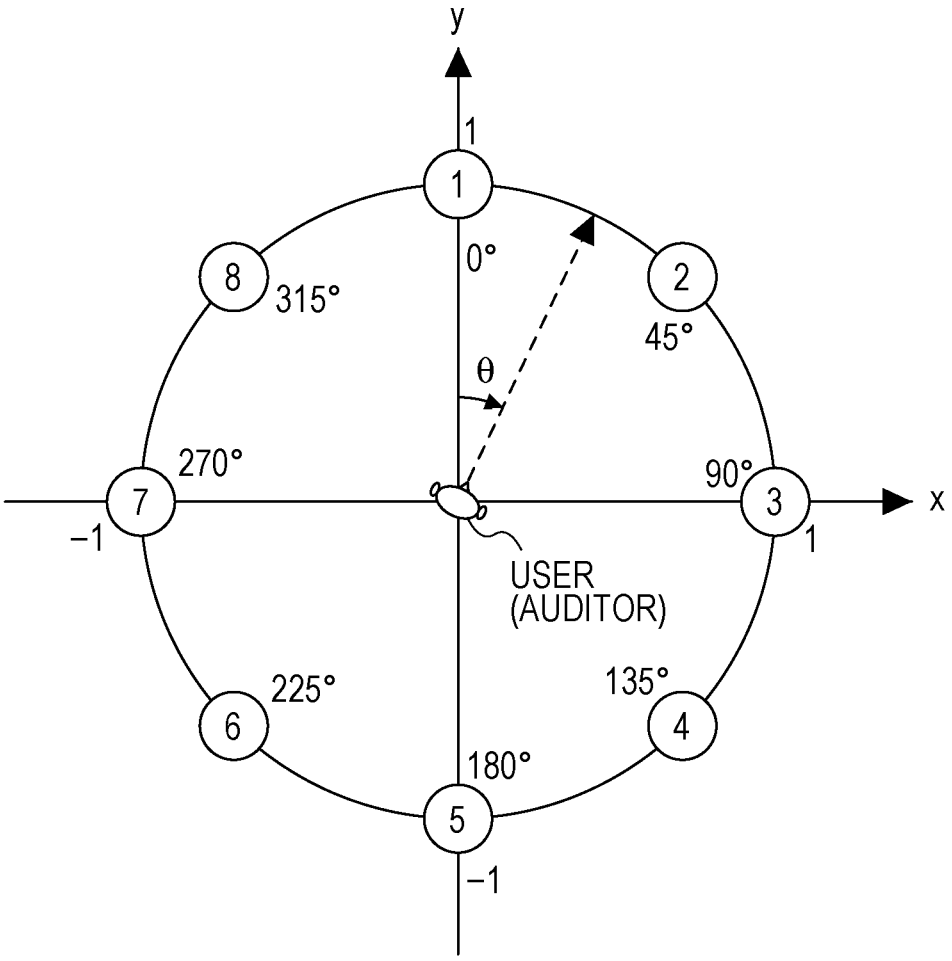
FIG. 6 illustrates an example of locations at which virtual speakers are placed.

FIG. 6 illustrates an example of the locations at which virtual speakers are placed. In the example in FIG. 6, the eight virtual speakers are placed at 45-degree intervals around the user's (auditor's) head on the circumference of a circle with a radius of 1. In the virtual speaker placement information 25-1 or 37-1 in FIG. 5B, the x and y coordinates of the virtual speakers that match the placement example in FIG. 6 are stored.

In the first embodiment, the forward deciding unit 32 compares the head orientation information indicated in FIG. 5A with the virtual speaker placement information indicated in FIG. 5B, determines the closest virtual speaker with respect to the front of the user, and selects a prescribed number of virtual speakers sequentially from the closest virtual speaker.

If, for example, a virtual speaker is assigned at a position with an angle indicated in the orientation information, the forward deciding unit 32 selects that virtual speaker. If a virtual speaker is not assigned at a position with an angle indicated in the orientation information, the forward deciding unit 32 selects two virtual speakers sequentially from the one closest to the angle.

For example, a decision will be made as to a forward virtual speaker by using the placement example in FIG. 6. If θ is 15 degrees, the forward deciding unit 32 decides that there is no virtual speaker at the forward of the forward deciding unit 32 (at its front) and selects, for example, two virtual speakers 1 and 2 sequentially from the one closest to the front. If θ is 90 degrees, the forward deciding unit 32 decides that virtual speaker 3 is present at the forward of the forward deciding unit 32 (at its front) and selects, for example, virtual speaker 3.

Selection of virtual speakers is not limited to the example described above. For example, if no virtual speaker is assigned to the frontal orientation, the forward deciding unit 32 may select two virtual speakers on the right side and two virtual speakers on the left side (a total of four virtual speakers) with respect to the front. If a virtual speaker is assigned to the frontal orientation, the forward deciding unit 32 may select the virtual speaker at the front and virtual speakers on its two sides (a total of three virtual speakers).

Items in the forward information 37-2 indicated in FIG. 5C include, for example, forward virtual speakers, but this is not a limitation. For example, the forward information 37-2 may include information about a backward virtual speaker. Alternatively, the forward information 37-2 may include, for example, information about both forward and backward virtual speakers, in which case the forward information 37-2 includes identification information that identifies the forward and backward virtual speakers. In the example in FIG. 5C, 1 and 2 are stored as the IDs of the forward virtual speakers as to which the forward deciding unit 32 has made a decision.

Items in the codec table 37-3 indicated in FIG. 5D include, for example, a virtual speaker type, codec, and parameters, but this is not a limitation. The codec table 37-3 is information controlled by the codec control unit 33. The virtual speaker type indicated in FIG. 5D is information that identifies a virtual speaker for which codec, parameters, and the like are to be set. In the example in FIG. 5D, virtual speaker types are identified by "forward" and "others", but this is not a limitation. For example, each virtual speaker may be identified. The use of the codec table 37-3 enables desired codec and parameters to be set for each virtual speaker type.

"Codec" indicated in FIG. 5D is, for example, a codec method that is set for each virtual speaker. In the codec column, "non-compression" indicates null codec (compression is not performed), and "sampling" indicates downsampling (compression is performed under conditions that are set by, for example, parameters or the like). However, this is not a limitation.

"Parameters" in FIG. 5D indicate various types of parameters used in compression performed under the condition that is set by "codec". In the example in FIG. 5D, a frequency (44 kHz or the like, for example), the amount of data (16 bits, for example), and the number of frames (1024 frames, for example) are set. However, parameters are not limited to these. For example, at least one of the frequency, the amount of data, and the number of frames described above may be set or other information may be included.

An item in codec information indicated in FIG. 5E is, for example, "codec information" or the like, but this is not a limitation. "Codec information" indicated in FIG. 5E is, for example, information obtained when each sound data item is compressed by the compressing unit 36 for each virtual speaker type according to the codec table 37-3, described above, in the FIG. 5D, but this is not a limitation.

The codec information in FIG. 5E indicates that sound data for the virtual speakers with IDs of, for example, 1 and 2 is non-compressed sound data of a high-frequency component (44 kHz) and that sound data for the virtual speakers with IDs of, for example, 3 to 8 is sound data obtained by reducing (downsampling) the sampling rate (frequency) to 22 kHz.

As described above, in the first embodiment, appropriate sounds may be output. In the first embodiment, communication bands may be deleted unlike a case in which all sound data (channels) transmitted from the supply server 12 includes a high-frequency component. In the first embodiment, the reproducing apparatus 11 may output sounds with appropriate perception of sound image localization at the forward.

Figure 7:
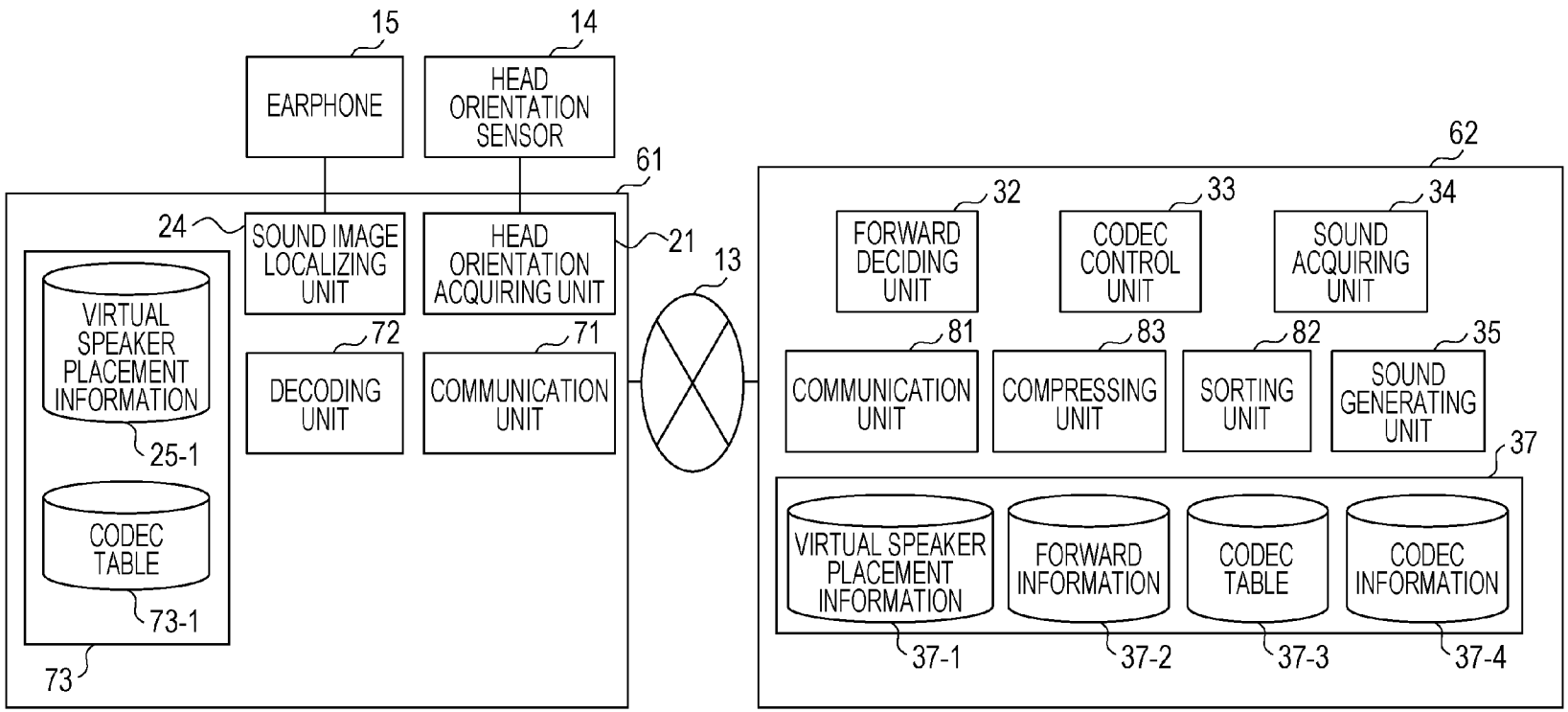
FIG. 7 illustrates an example of the structure of a sound processing system in a second embodiment.

Example of the General Structure of a Sound Processing System in a Second Embodiment Next, a sound processing system in a second embodiment will be described. FIG. 7 illustrates an example of the structure of the sound processing system in the second embodiment. Although, in the first embodiment described above, an example of compression by downsampling has been described, an example of sound stream switching will be described in the second embodiment.

In the sound processing system 60 illustrated in FIG. 7, elements that are the same as in the sound processing system 10 described above are given the same reference numerals, and their specific descriptions will be omitted in the second embodiment. A reproducing apparatus and a supply server in the sound processing system 60 may have the same hardware structure as in the first embodiment described above, so their specific descriptions will also be omitted in the second embodiment.

The sound processing system 60 in FIG. 7 includes a reproducing apparatus 61, and a supply server 62. The reproducing apparatus 61 and supply server 62 are interconnected through the communication network 13 typified by, for example, the Internet, a WLAN, a LAN, and other networks so that transmission and reception of data are possible. The communication network 13 in the second embodiment is a network that remains connected through connections.

The reproducing apparatus 61 includes the head orientation acquiring unit 21, a communication unit 71, a decoding unit 72, the sound image localizing unit 24, and a storage unit 73. The storage unit 73 stores the virtual speaker placement information 25-1 and a codec table 73-1. The reproducing apparatus 61 in the second embodiment has the same structure as the reproducing apparatus 11 in the first embodiment, but differs from the reproducing apparatus 11 in processing by the communication unit 71 and decoding unit 72. The codec table 73-1 stored in the storage unit 73 is obtained from the supply server 62 after the reproducing apparatus 61 has started a session with the supply server 62.

The supply server 62 includes a communication unit 81, the forward deciding unit 32, the codec control unit 33, the sound acquiring unit 34, the sound generating unit 35, a sorting unit 82, a compressing unit 83, and the storage unit 37. The supply server 62 in the second embodiment differs from the supply server 12 in the first embodiment described above in that the supply server 62 has the sorting unit 82 and in processing by the communication unit 81 and compressing unit 83.

In the second embodiment, the communication unit 81 in the supply server 62 uses different communication paths to transmit sound data corresponding to the user's forward and sound data corresponding to directions other than the user's forward, the sound data being obtained from the compressing unit 83. When, for example, communicating with the reproducing apparatus 61 through the communication network 13, the communication unit 81 establishes connections with communication paths at a high compression ratio (for high compression) and communication paths at a low compression ratio (for low compression) in advance.

The communication unit 81 also transmits the codec table 37-3 to the reproducing apparatus 61. The codec table 37-3 in the second embodiment includes information indicating what codec and a parameter are used for what communication path and other information, but this is not a limitation. For example, the codec table 37-3 may include, for example, virtual speaker types.

The sorting unit 82 in the supply server 62 sorts sound data corresponding to individual virtual speakers (individual channels), the sound data being obtained from the sound generating unit 35, to one of the two types of compression conditions, according to the codec table 37-3 created by the codec control unit 33. The compressing unit 83 compresses sound data under the virtual-speaker-specific compression condition to which the sound data has been sorted by the sorting unit 82.

For example, the sorting unit 82 sorts sound data so that the low-compression condition takes effect for a prescribed number of virtual speakers at the forward of the user and that the high-compression condition takes effect for the virtual speakers other than the forward virtual speakers, according to the user's orientation information obtained from the reproducing apparatus 61. The method of deciding whether the virtual speaker is a forward virtual speaker is the same as in the first embodiment described above, so a description of the method will be omitted.

Figure 8:
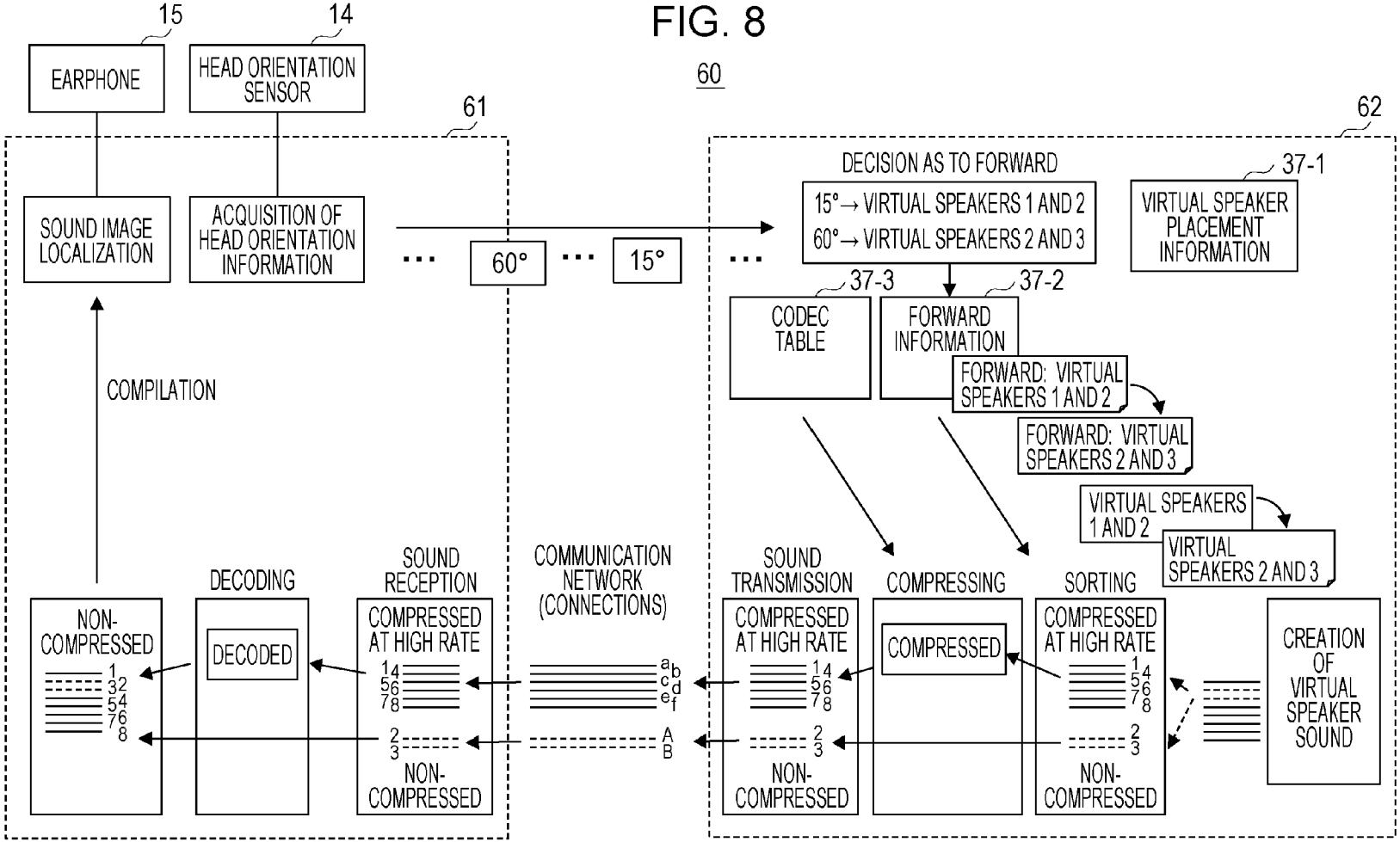
FIG. 8 illustrates an operation performed by the sound processing system in the second embodiment.

FIG. 8 illustrates an operation performed by a sound processing system in the second embodiment. The example in FIG. 8 only schematically illustrates the sound processing system 60 in the second embodiment.

In the second embodiment, as illustrated in the example in FIG. 8, a prescribed number of communication paths for data compressed at a high rate and a prescribed number of communication paths for data compressed at a low rate are used to establish connections for data communication between the reproducing apparatus 61 and the supply server 62. For example, in the second embodiment, connections are established to transmit and receive sound data corresponding to, for example, eight channels between the communication unit 71 in the reproducing apparatus 61 and the communication unit 81 in the supply server 62. To establish connections, the communication units 71 and 81 use, for example, communication paths a to f in six narrow bands used to transmit sound data compressed at a high rate and communication paths A and B in two wind bands used to transmit sound data compressed at a low rate. However, this is not a limitation to the number of connections in the second embodiment.

The sorting unit 82 creates sound data corresponding to virtual speakers, for example, in a plurality of channels (eight channels) and sorts each created sound data item according to whether the sound data item corresponds to a forward virtual speaker.

The compressing unit 83 compresses sound data that corresponds to forward virtual speakers and is to be transmitted to two transmission paths A and B at a low rate or does not compress the sound data, that is, leaves it uncompressed. That is, the high-frequency component remains after restoration. The compressing unit 83 also compresses sound data that corresponds to virtual speakers other than the forward virtual speakers and is to be transmitted to six communication paths a to f at a high rate. Therefore, sound data after restoration lacks the high-frequency component.

In the example in FIG. 8, it will be assumed that, for example, the initial value of the head orientation information θ, which is output from the head orientation sensor 14, was 15 degrees with respect to an azimuth with the north being 0 degree and has been changed to 60 degrees after the elapse of a prescribed time. As described above with reference to FIGS. 5B and 6, the forward deciding unit 32 first selects two virtual speakers 1 and 2 in correspondence of θ being 15 degrees. Accordingly, sound data corresponding to the virtual speakers 1 and 2 is transmitted to two communication paths A and B. Sound data that corresponds to the other virtual speakers 3 to 8 and has been compressed at a high rate is transmitted to six communication paths a to f.

If the head orientation information θ has changed to 60 degrees after that, the forward deciding unit 32 selects virtual speakers 2 and 3 as the forward virtual speakers. That is, the two virtual speakers to be selected change from virtual speakers 1 and 2 to virtual speakers 2 and 3. In this case, the sorting unit 82 changes sound data to be sorted to communication paths A and B and sound data to be sorted to communication paths a to f according to the timing at which the orientation information is changed, enabling information to be transmitted seamlessly.

For example, the communication unit 81 uses two communication paths A and B to transmit sound data corresponding to virtual speakers 2 and 3. The communication unit 81 also uses six communication paths a to f to transmit sound data that corresponds to the other virtual speakers 1 and 4 to 8 and has been compressed at a high rate.

Since, in the second embodiment, the lines of the communication network 13 remain connected, transmission and reception of the codec information may be done in one operation. In the second embodiment, the communication paths to be used are not switched, so it is possible to fix memory allocation.

In the reproducing apparatus 61 in the second embodiment, the communication unit 71 receives sound data transmitted through the two types of communication paths described above. The decoding unit 72 decodes each data that has been transmitted through one of these communication paths by using the codec table 73-1 that has been received in advance by a decoding method that matches the communication path, after which the decoding unit 72 compiles decoding results and outputs sound data for which a sound image has been localized from the earphone 15.

Example of Processing by the Compressing Unit 83 in the Second Embodiment

Figure 9:
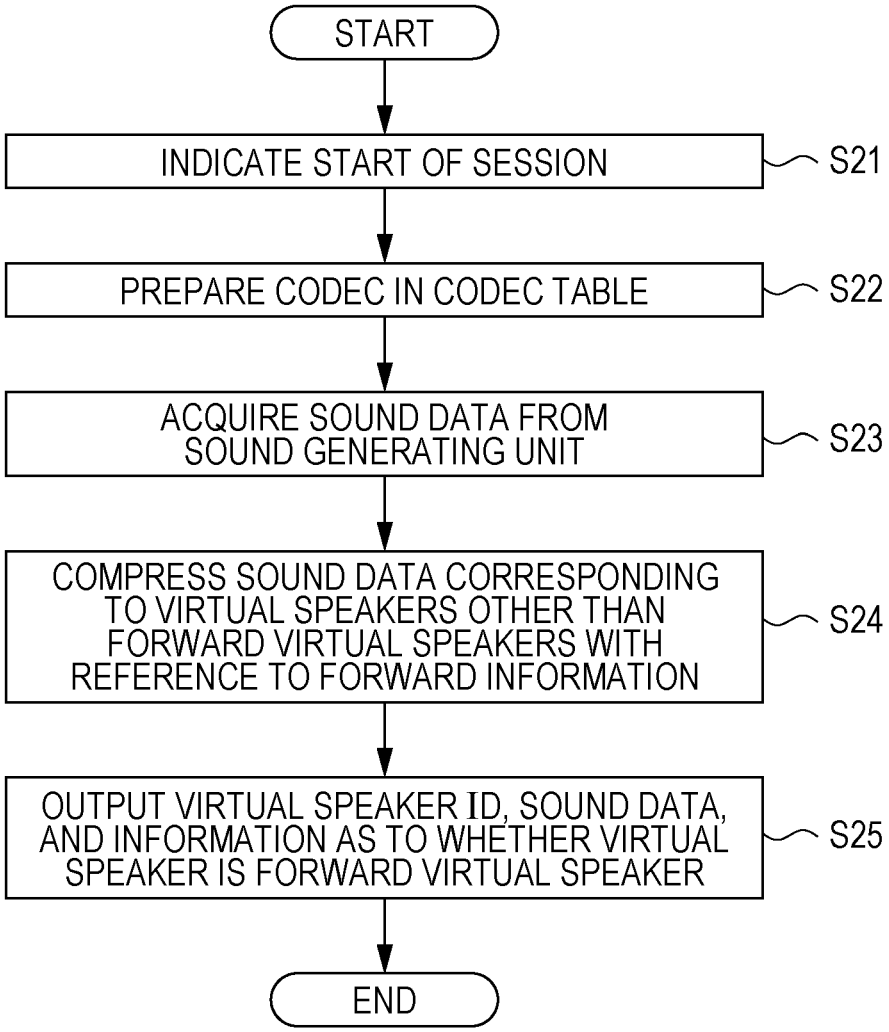
FIG. 9 is a flowchart illustrating an example of processing performed by a compressing unit in the second embodiment.

FIG. 9 is a flowchart illustrating an example of processing performed by a compressing unit in the second embodiment. In the example in FIG. 9, the compressing unit 83 is notified by the codec control unit 33 that a session with the reproducing apparatus 61 has been started (S21). The compressing unit 83 then prepares codec in the codec table 37-3 stored in the storage unit 37 (S22).

The compressing unit 83 then acquires sound data corresponding to virtual speakers from the sound generating unit 35 (S23) and compresses sound data corresponding to the virtual speakers other than the forward virtual speakers with reference to the forward information 37-2 (S24). In this case, the sound data corresponding to the forward virtual speakers are left non-compressed.

Next, the compressing unit 83 outputs, to the communication unit 81, identification information (virtual speaker ID) that identifies a virtual speaker, sound data corresponding to the ID, and information as to whether the virtual speaker with the ID is a forward virtual speaker (S25).

Figure 10:
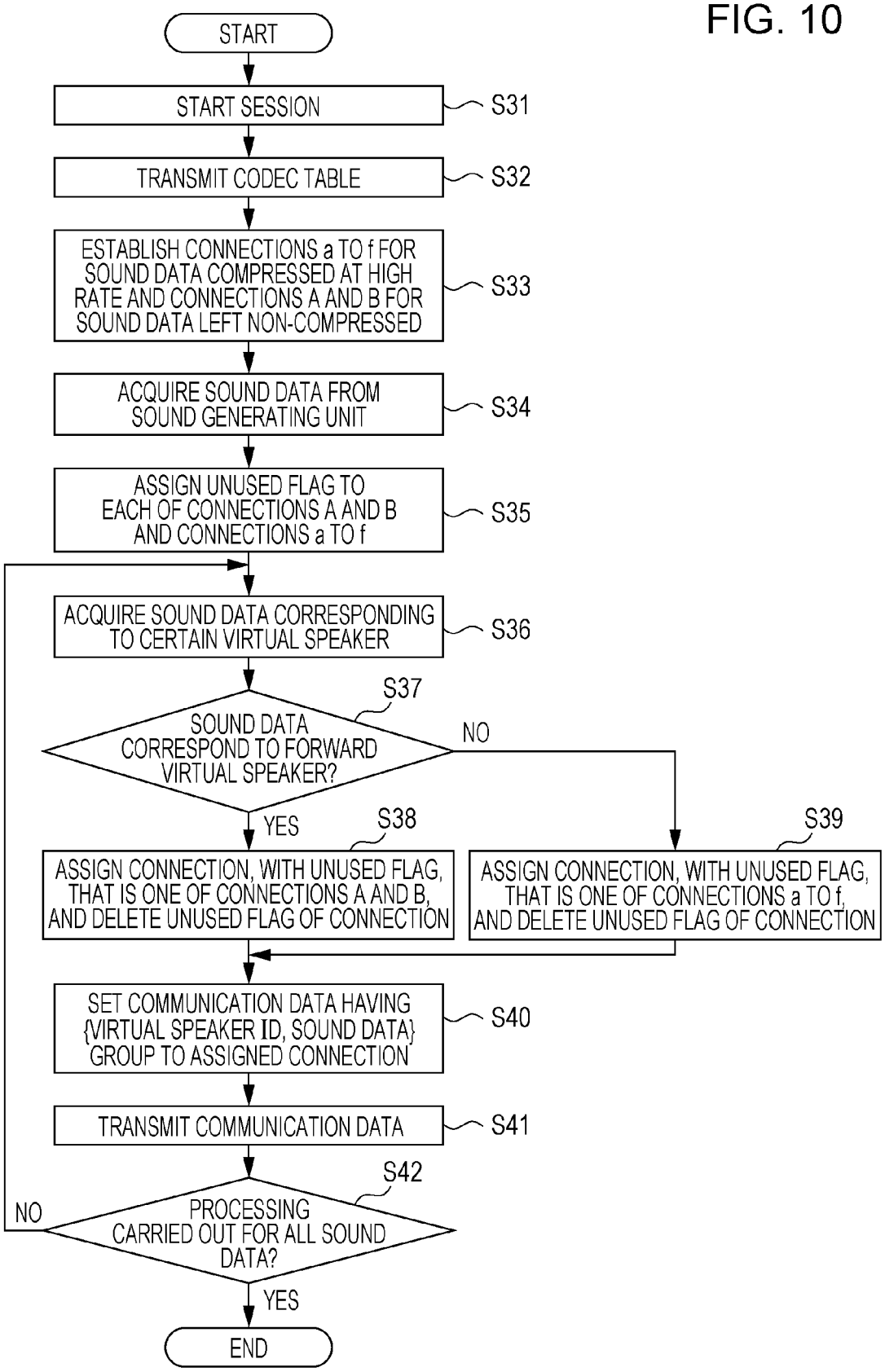
FIG. 10 is a flowchart illustrating an example of processing performed by a communication unit in a supply server in the second embodiment.

Example of Processing by the Communication Unit 81 in the Supply Server 62 in the Second Embodiment FIG. 10 is a flowchart illustrating an example of processing performed by a communication unit in a supply server in the second embodiment. In processing below, an example will be described in which sound data compressed at a low rate or left non-compressed, which is part of the eight-channel sound data, is transmitted through two connections (communication paths) A and B and sound data compressed at a high rate is transmitted through six connections a to f, as described above. However, this is not a limitation.

In the example in FIG. 10, the communication unit 81 starts a session with the reproducing apparatus 61 (S31) and transmits the codec table 37-3 to the reproducing apparatus 61 (S32). The communication unit 81 then establishes, for example, connections a to f for sound data compressed at a high rate and connections A and B for sound data left non-compressed (S33).

Next, the communication unit 81 acquires compressed or non-compressed sound data from the compressing unit 83 for each virtual speaker (S34), and assigns an unused flag to each of connections A and B and connections a to f (S35). The communication unit 81 then acquires sound data corresponding to a certain virtual speaker (S36) and decides whether the sound data corresponds to a forward virtual speaker (S37). The certain virtual speaker is, for example, one of all virtual speakers 1 to 8 that corresponds to sound data yet to be transmitted to the reproducing apparatus 61.

If the sound data corresponds to a forward virtual speaker in the processing in S37 (the result in S37 is Yes), then the communication unit 81 assigns a connection, with an unused flag, that is one of connections A and B, and deletes the unused flag from the connection (S38). Deletion of the unused flag indicates that the connection has been used.

If the sound data does not correspond to a forward virtual speaker (the result in S37 is No), then the communication unit 81 assigns a connection, with an unused flag, that is one of connections a to f, and deletes the unused flag from the connection (S39).

Next, the communication unit 81 sets communication data having a {virtual speaker ID, sound data} group to the assigned connection (S40), and transmits the communication data to the reproducing apparatus 61 through the assigned connection (S41).

The communication unit 81 decides whether processing has been carried out for all sound data (S42). If processing has not been carried out for all sound data (the result in S42 is No), the sequence returns to S36, where the communication unit 81 carries out processing on non-processed sound data. If processing has been carried out for all sound data (the result in S42 is Yes), then the communication unit 81 terminates the processing.

Figure 11:
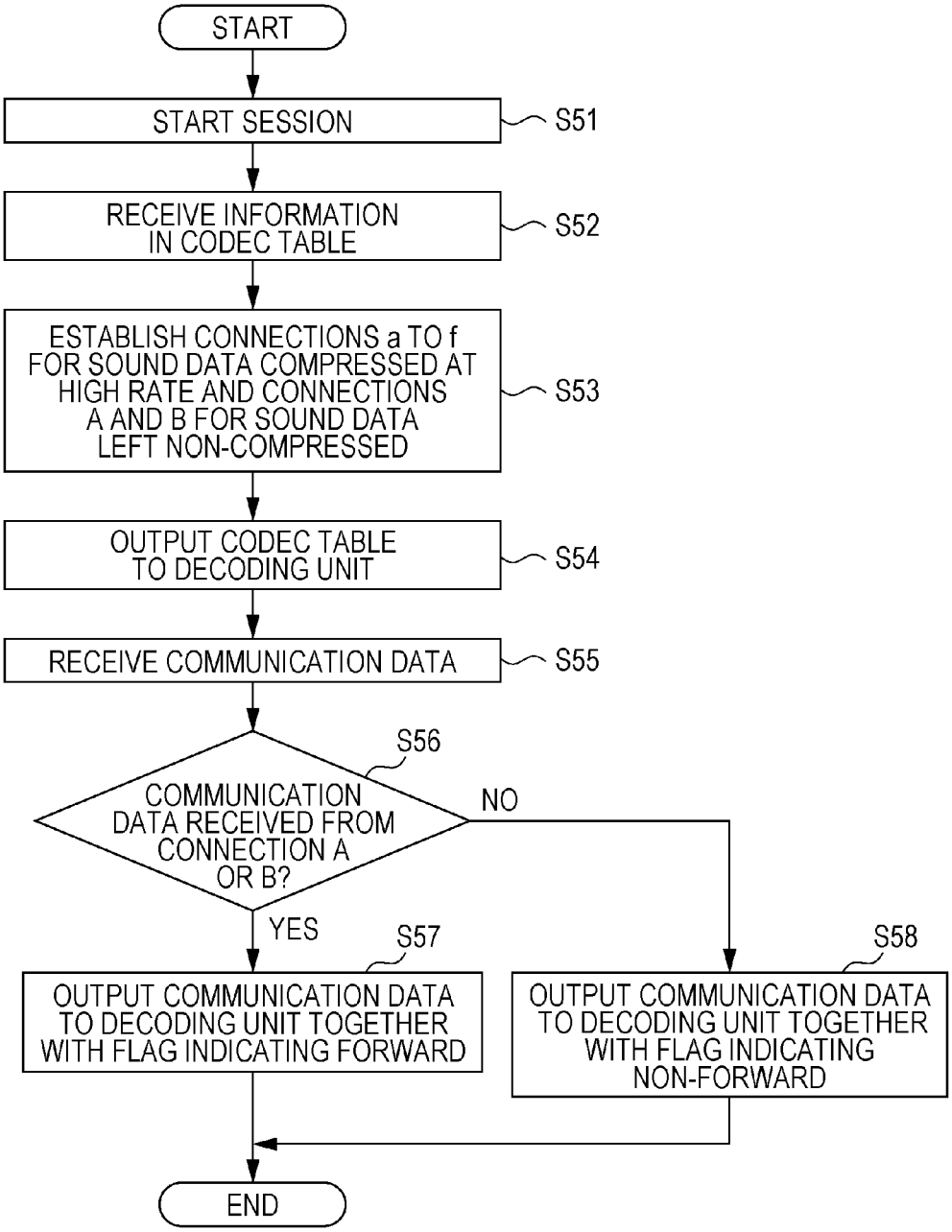
FIG. 11 is a flowchart illustrating an example of processing performed by a communication unit in a reproducing apparatus in the second embodiment.

Example of Processing by the Communication Unit 71 in the Reproducing Apparatus 61 in the Second Embodiment Next, an example of processing performed by the communication unit 71 in the reproducing apparatus 61 in the second embodiment will be described with reference to a flowchart. FIG. 11 is a flowchart illustrating an example of processing performed by a communication unit in a reproducing apparatus in the second embodiment. In the example in FIG. 11, processing on the communication data that has been transmitted from the supply server 62 in the processing described above with reference to FIG. 10 will be described, but this is not a limitation.

In the example in FIG. 11, the communication unit 71 starts a session with the supply server 62 (S51), and receives the codec table 37-3 from the supply server 62 (S52). The communication unit 71 then establishes connections a to f for sound data compressed at a high rate and connections A and B for sound data left non-compressed (S53). The communication unit 71 then outputs information included in the codec table 37-3 to the decoding unit 72 (S54). The codec table 37-3 may have been stored in the storage unit 73 as the codec table 73-1, and the codec table 73-1 may be referenced from the storage unit 73 when the decoding unit 72 performs decoding.

The communication unit 71 then receives the communication data from the supply server 62 (S55), and decides whether the communication data has been received through connection A or B (S56). If the communication data has been received through connection A or B (the result in S56 is Yes), then the communication unit 71 outputs the communication data to the decoding unit 72 together with a flag indicating the forward (S57). If the communication data has been received from neither connection A nor B (the result in S56 is No), then the communication unit 71 outputs the communication data to the decoding unit 72 together with a flag indicating a non-forward (a direction other than the forward) (S58). Since, in the processing in S57, a flag indicating the forward is assigned, communication data without that flag may be decided to be communication data not corresponding to the forward. According, the processing in S58 described above may be omitted.

Thus, the decoding unit 72 does not decode communication data with, for example, a flag indicating the forward because the communication data has not been compressed, and decodes communication data other than for the forward by a decoding method (decodec) corresponding to codec in the codec table 73-1 or the like. The decoding unit 72 also outputs the decoded sound data and the like to the sound image localizing unit 24. Then, the sound image localizing unit 24 may compile sound data obtained from the decoding unit 72 and may output, from the earphone 15, appropriate sound data that has a high-frequency component so as to localize a sound image at the forward.

As described above, in the second embodiment, appropriate sound may be output. Since, in the second embodiment, communication paths for sound data compressed at a high rate (low band) and communication paths for sound data compressed at a low rate (high band) are prepared so that they are used without being switched, transmission and reception of the codec information may be done in one operation. In the second embodiment, it is also possible to fix memory allocation.

Figure 12:
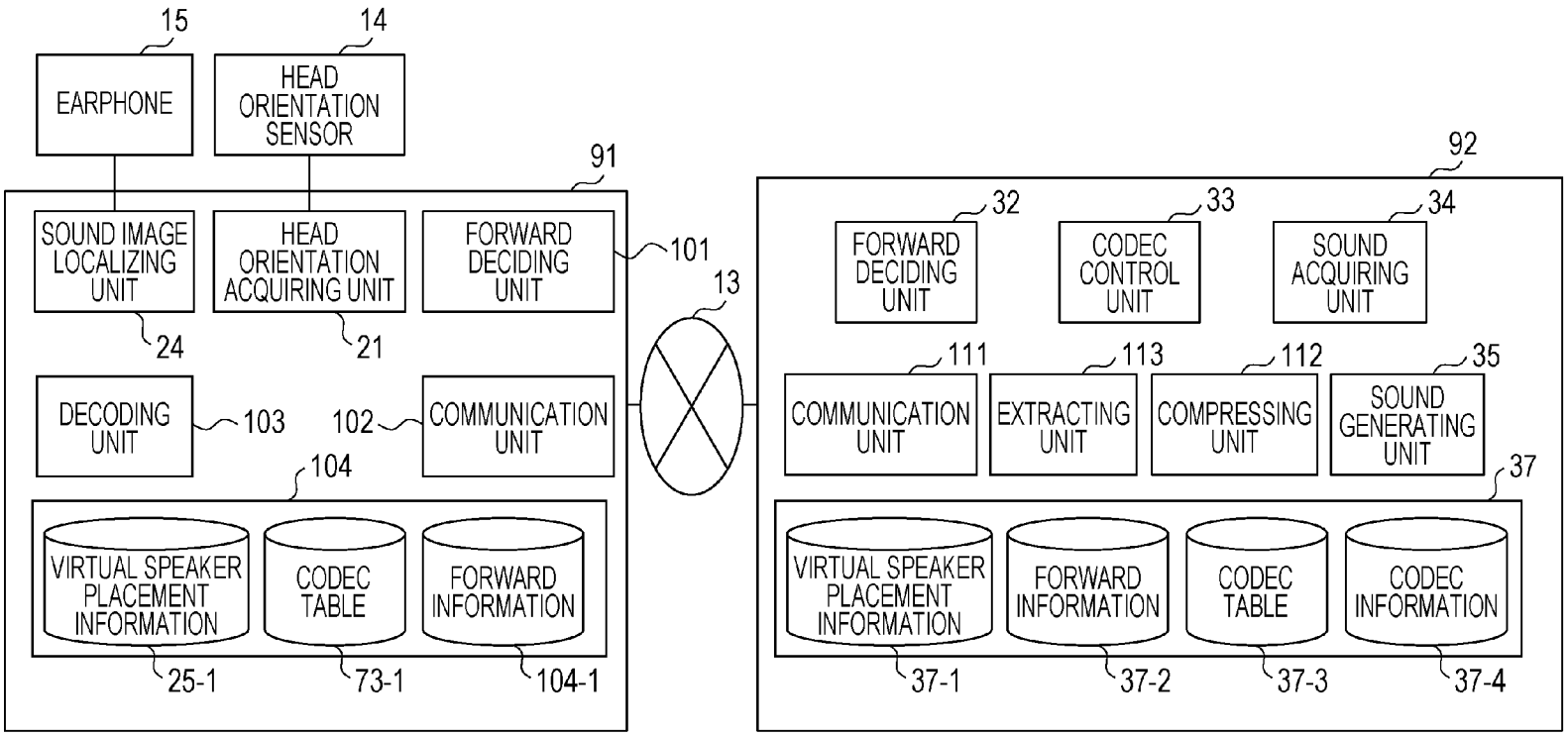
FIG. 12 illustrates an example of the structure of a sound processing system in a third embodiment.

Example of the General Structure of a Sound Processing System in a Third Embodiment Next, a sound processing system in a third embodiment will be described. FIG. 12 illustrates an example of the structure of the sound processing system in the third embodiment. In the third embodiment, an example of sound stream switching that differs sound stream switching in the second embodiment will be described.

In the sound processing system 90 illustrated in FIG. 12, elements that are the same as in the sound processing systems 10 and 80 described above are given the same reference numerals, and specific descriptions of these elements will be omitted in the third embodiment. A reproducing apparatus and a supply server in the sound processing system 90 may have the same hardware structure as in the first embodiment described above, so their specific descriptions will also be omitted in the third embodiment.

The sound processing system 90 in FIG. 12 includes a reproducing apparatus 91, and a supply server 92. The reproducing apparatus 91 and supply server 92 are interconnected through the communication network 13 typified by, for example, the Internet, a WLAN, and other networks so that transmission and reception of data are possible. The communication network 13 in the third embodiment is a network that remains connected through connections.

The reproducing apparatus 91 includes the head orientation acquiring unit 21, a forward deciding unit 101, a communication unit 102, a decoding unit 103, the sound image localizing unit 24, and a storage unit 104. The storage unit 104 stores the virtual speaker placement information 25-1, codec table 73-1, and forward information 104-1.

The supply server 92 includes a communication unit 111, the forward deciding unit 32, the codec control unit 33, the sound acquiring unit 34, the sound generating unit 35, a compressing unit 112, an extracting unit 113, and the storage unit 37.

In the third embodiment, as illustrated in FIG. 12, the reproducing apparatus 91 has the forward deciding unit 101 and the supply server 92 also has the forward deciding unit 32; both the reproducing apparatus 91 and supply server 92 decide the forward of the user to select virtual speakers corresponding to the forward. In the third embodiment, therefore, it is possible to omit transmission and reception of information between the reproducing apparatus 91 and the supply server 92, the information indicating sounds corresponding to the forward, so the amount of communication may be reduced, improving the communication efficiency.

In the third embodiment, sound data created by the sound generating unit 35 in correspondence to each virtual speaker is separated into a low-frequency component and a high-frequency component, after which they are compressed separately. In addition, in the third embodiment, sound data of the low-frequency components corresponding to all virtual speakers is transmitted to the reproducing apparatus 91, and sound data of the high-frequency components corresponding to the virtual speakers at the forward of the user is also transmitted to the reproducing apparatus 91.

Figure 13:
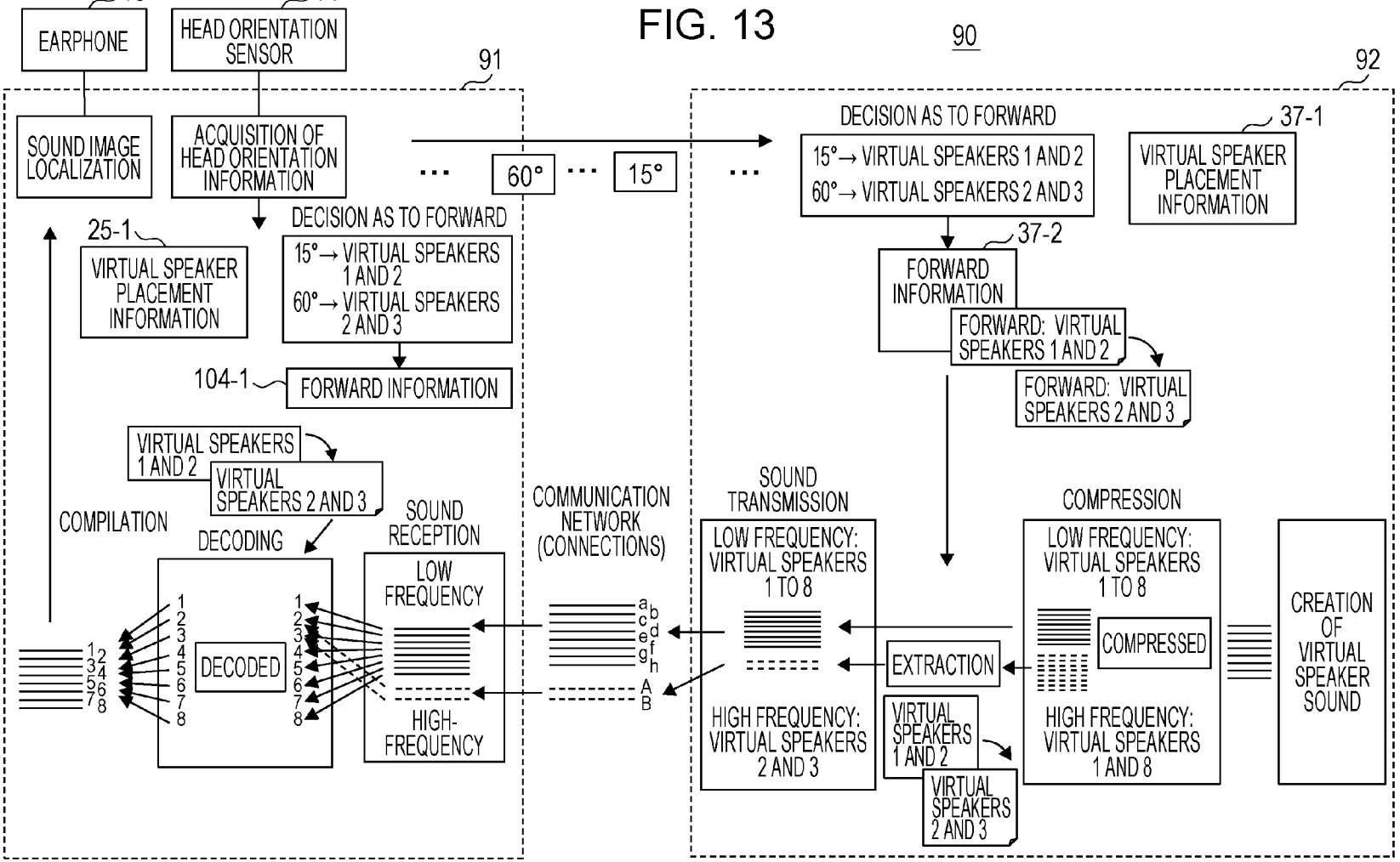
FIG. 13 illustrates an operation performed by the sound processing system in the third embodiment.

FIG. 13 illustrates an operation performed by a sound processing system in the third embodiment. The example in FIG. 13 only schematically illustrates the sound processing system 90 in the third embodiment.

In the third embodiment, eight connections (communication paths) a to h for low-frequency components and two connections A and B for high-frequency components, for example, are established at the start of a session between the communication unit 102 in the reproducing apparatus 91 and the communication unit 111 in the supply server 92. However, this is not a limitation to the number of connections in the third embodiment.

The compressing unit 112 in the supply server 92 separates all virtual-speaker-specific sound data (in eight channels, for example) created by the sound generating unit 35 into a low-frequency component and a high-frequency component, after the compressing unit 112 compresses them separately. As the compression method used by the compressing unit 112, scalable sound coding such as Scalable Sample Rate (SSR) in Moving Picture Experts Group 2—Advanced Audio Coding (MPEG2-AAC) may be used, but this is not a limitation.

The extracting unit 113 extracts data corresponding to the forward of the user from the compressed sound data of the high-frequency components corresponding to all virtual speakers, the compressed sound data being obtained from the compressing unit 112, according to the decision result made by the forward deciding unit 32. In the third embodiment, as for eight channels a to h, the sound data of the low-frequency components in all the eight channels is transmitted to the reproducing apparatus 91, as illustrated in FIG. 13. In addition, the sound data of the high-frequency components in the forward channels is transmitted through two connections A and B to the reproducing apparatus 91.

In the reproducing apparatus 91, the forward deciding unit 101 determines the forward according to the information acquired from the head orientation sensor 14 through the head orientation acquiring unit 21 and selects virtual speakers corresponding to the forward with reference to the virtual speaker placement information 25-1. The forward information 104-1 related to the selected virtual speaker is stored in the storage unit 104.

The decoding unit 103 references the forward information 104-1 and adds the sound data of the high-frequency components transmitted through two connections A and B described above to the sound data corresponding to the forward, the sound data being part of the sound data of the low-frequency components transmitted through eight connections a to h to decode the sound data. The decoding unit 103 also outputs the decoding result to the sound image localizing unit 24. The sound image localizing unit 24 compiles the obtained sound data and outputs sound data that has undergone sound image localization from the earphone 15.

In the example in FIG. 13, it will be assumed that, for example, the initial value of the head orientation information θ, which is output from the head orientation sensor 14, was 15 degrees with respect to an azimuth with the north being 0 degree and has been changed to 60 degrees after the elapse of a prescribed time. In the examples in FIGS. 5B and 6, forward virtual speakers are first virtual speakers 1 and 2 and then change to virtual speakers 2 and 3 as in the second embodiment described above.

In this case, of the high-frequency components of the sound data, the high-frequency components and low-frequency components of which had been compressed separately by the compressing unit 112, the extracting unit 113 first extracts sound data of the high-frequency components corresponding to virtual speakers 1 and 2, which have been decided to be forward virtual speakers. When the head orientation information described above changes (for example, θ changes from 15 degrees to 60 degrees), the extracting unit 113 extracts the sound data of the high-frequency components corresponding to virtual speakers 2 and 3.

The communication unit 111 transmits the sound data of the low-frequency components corresponding to all virtual speakers 1 to 8 and also transmits the sound data of the high-frequency components that has been selectively extracted by the extracting unit 113.

Accordingly, in the third embodiment, the sound data of the low-frequency components is continuously transmitted, enabling the sound data to be transmitted seamlessly. Since, in the third embodiment, the communication lines remain connected, transmission and reception of the codec table 37-3 may be done in one operation. Since, in the third embodiment, both the reproducing apparatus 91 and supply server 92 make a decision as to the forward, transmission and reception of, for example, information corresponding to the forward information 104-1 and the like may be suppressed, so communication efficiency may be improved.

As described above, in the third embodiment, since information about differences (high-frequency components) between the original sound data and the sound data of the low-frequency components transmitted through connections a to h is transmitted through connections A and B intended for high-frequency components to the reproducing apparatus 91, appropriate sounds may be output from the reproducing apparatus 91.

Figure 14:
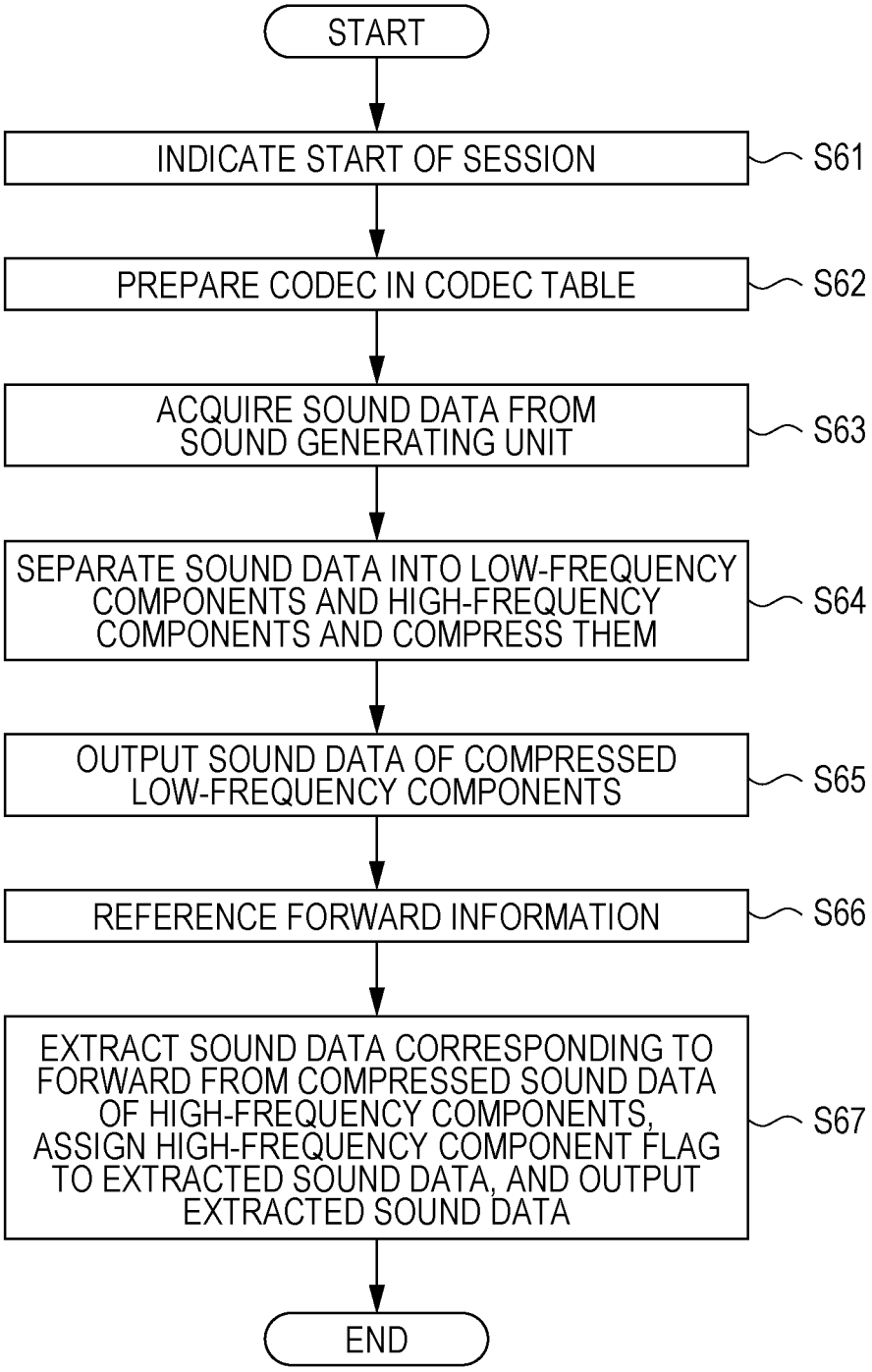
FIG. 14 is a flowchart illustrating an example of processing performed by a compressing unit and an extracting unit in the third embodiment.

Example of Processing by the Compressing Unit 112 and Extracting Unit 113 in the Third Embodiment FIG. 14 is a flowchart illustrating an example of processing performed by a compressing unit and an extracting unit in the third embodiment. In the example in FIG. 14, the compressing unit 112 is notified by the codec control unit 33 that a session with the reproducing apparatus 91 has been started (S61). The compressing unit 112 then prepares codec in the codec table 37-3 (S62).

The compressing unit 112 then acquires sound data corresponding to virtual speakers from the sound generating unit 35 (S63), after which the compressing unit 112 separates sound data into low-frequency components and high-frequency components and compresses them separately (S64). In the processing in S64, the compressing unit 112 performs separation into a low-frequency component and a high-frequency component and compression on all sound data corresponding to all channels of the preset virtual speakers. The low-frequency component and high-frequency component may be compressed in the same compression format or may be compressed in different compression formats. A compression format may be selected for each low-frequency component and for each high-frequency component. The compressing unit 112 then outputs the compressed sound data of the low-frequency components to the communication unit 111 and the like (S65).

The extracting unit 113 references the forward information 37-2 in which a decision by the forward deciding unit 32 has been reflected (S66), extracts sound data corresponding to the forward from the compressed sound data of the high-frequency components, assigns a high-frequency component flag to the extracted sound data, and outputs the extracted sound data to the communication unit 111 and the like (S67). In the processing in S67, if the reproducing apparatus 91 may detect a connection through which the sound data has been received, it is possible to decide whether the sound data is sound data of a high-frequency component. In this case, the high-frequency component flag may not be assigned in the processing in S67.

Figure 15:
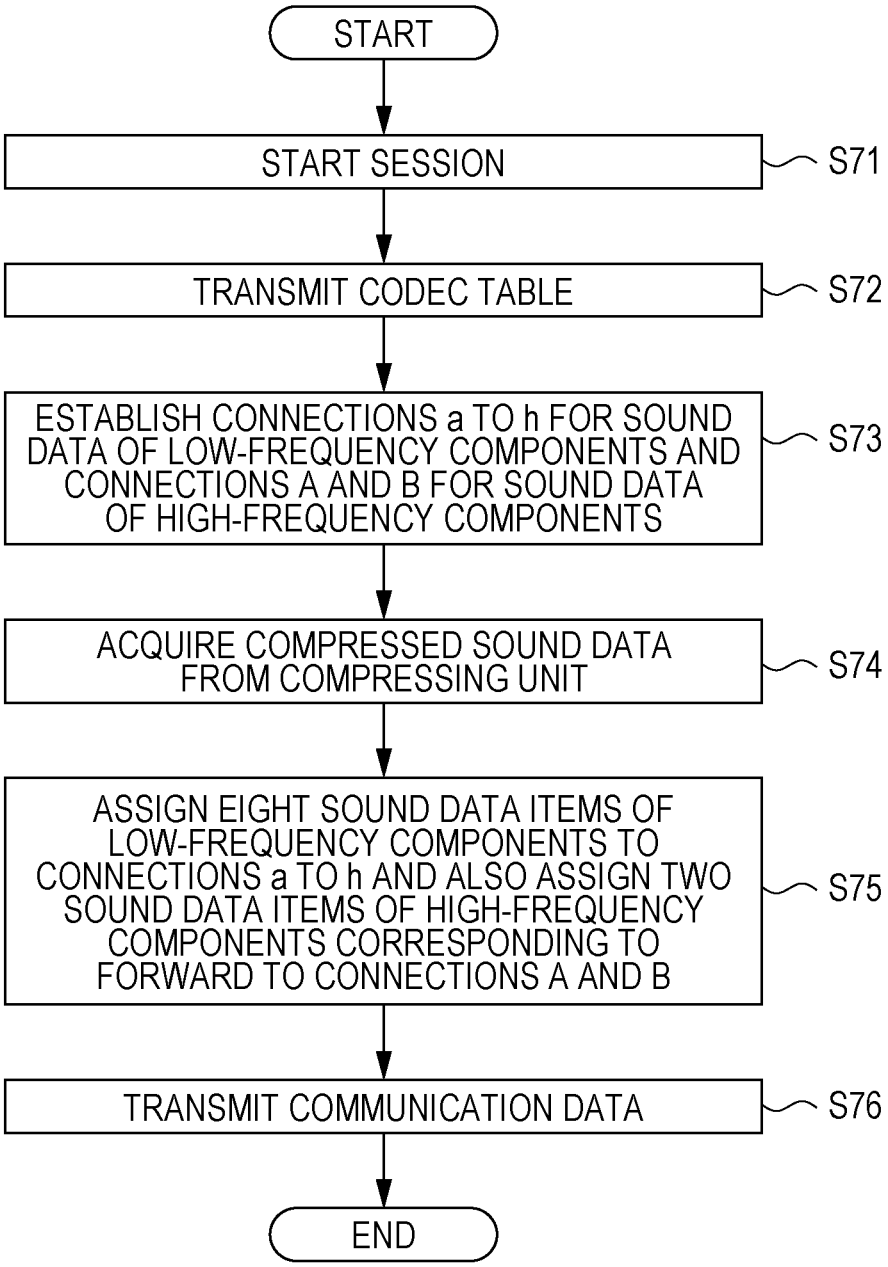
FIG. 15 is a flowchart illustrating an example of processing performed by a communication unit in a supply server in the third embodiment.

Example of Processing by the Communication Unit 111 in the Supply Server 92 in the Third Embodiment FIG. 15 is a flowchart illustrating an example of processing performed by a communication unit in a supply server in the third embodiment. In the example in FIG. 15, the communication unit 111 starts a session with the reproducing apparatus 91 (S71) and transmits the codec table 37-3 to the reproducing apparatus 91 (S72). The communication unit 111 then establishes connections a to h for sound data of low-frequency components and connections A and B for sound data of high-frequency components (S73).

The communication unit 111 then acquires compressed sound data from the compressing unit 112 (S74), after which the communication unit 111 assigns eight sound data items of low-frequency components to connections a to h and also assigns two sound data items of high-frequency components corresponding to the forward to connections A and B (S75). The communication unit 111 then transmits communication data through the connections to the reproducing apparatus 91 (S76).

Figure 16:
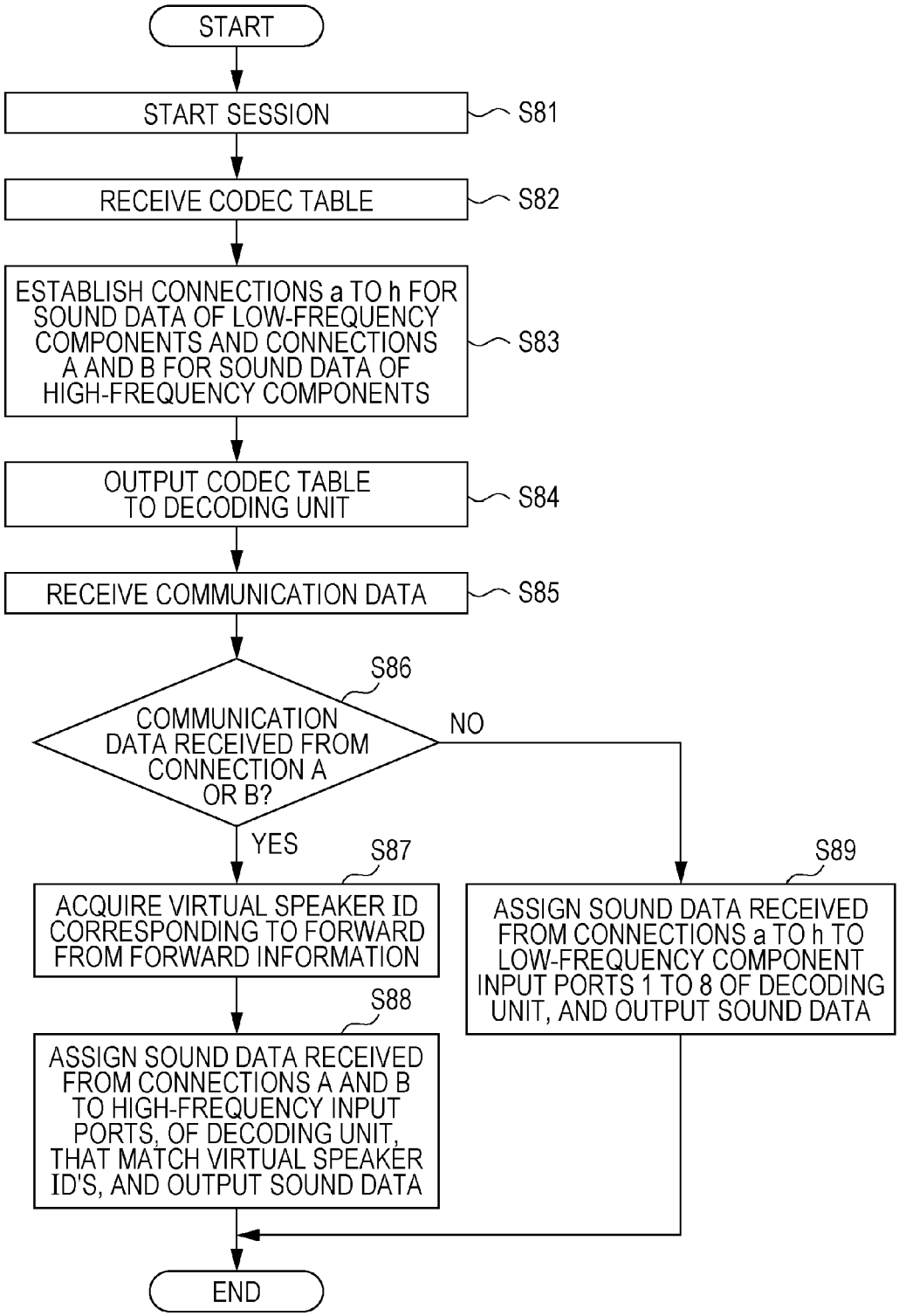
FIG. 16 is a flowchart illustrating an example of processing performed by a communication unit in a reproducing apparatus in the third embodiment.

Example of Processing by the Communication Unit 102 in the Reproducing Apparatus 91 in the Third Embodiment FIG. 16 is a flowchart illustrating an example of processing performed by a communication unit in a reproducing apparatus in the third embodiment. Although processing on the communication data transmitted from the supply server 92 described above will be described, processing by the communication unit 102 is not limited to this.

In the example in FIG. 16, the communication unit 102 starts a session with the supply server 92 (S81) and receives the codec table 37-3 from the supply server 92 (S82). The communication unit 102 then establishes connections a to f for sound data of low-frequency components and connections and B for sound data of high-frequency components (S83).

The communication unit 102 then outputs information in the codec table 37-3 to the decoding unit 103 (S84). The codec table 37-3 may be stored in the storage unit 104 as the codec table 73-1, and the codec table 73-1 may be referenced from the storage unit 104 when the decoding unit 103 performs decoding.

The communication unit 102 then receives the communication data from the supply server 92 (S85), and decides whether the communication data has been received from connection A or B (S86). In the processing in S86, it may be decided whether the high-frequency component flag described above has been assigned to the received communication data.

If the communication data has been received from connection A or B (the result in S86 is Yes), then the communication unit 102 acquires a virtual speaker ID corresponding to the forward from the forward information 104-1 in the reproducing apparatus 91 (S87). In the processing in S87, the head orientation acquiring unit 21 has acquired head orientation information from the head orientation sensor 14 in advance, the forward deciding unit 101 has decided the place of the forward from the acquired head orientation information, and the decision result has been stored in the forward information 104-1.

Next, the communication unit 102 assigns the sound data received from connections A and B to high-frequency input ports, of the decoding unit 103, that match the virtual speaker IDs, and outputs the sound data to the decoding unit 103 (S88). If the communication data has not been received from connection A or B in the processing in S86 (the result in S86 is No), then the communication unit 102 assigns the sound data received from connections a to h to low-frequency component input ports 1 to 8 of the decoding unit 103, and outputs the sound data to the decoding unit 103, assuming that the communication data has been received from connections a to h (S89).

Figure 17:
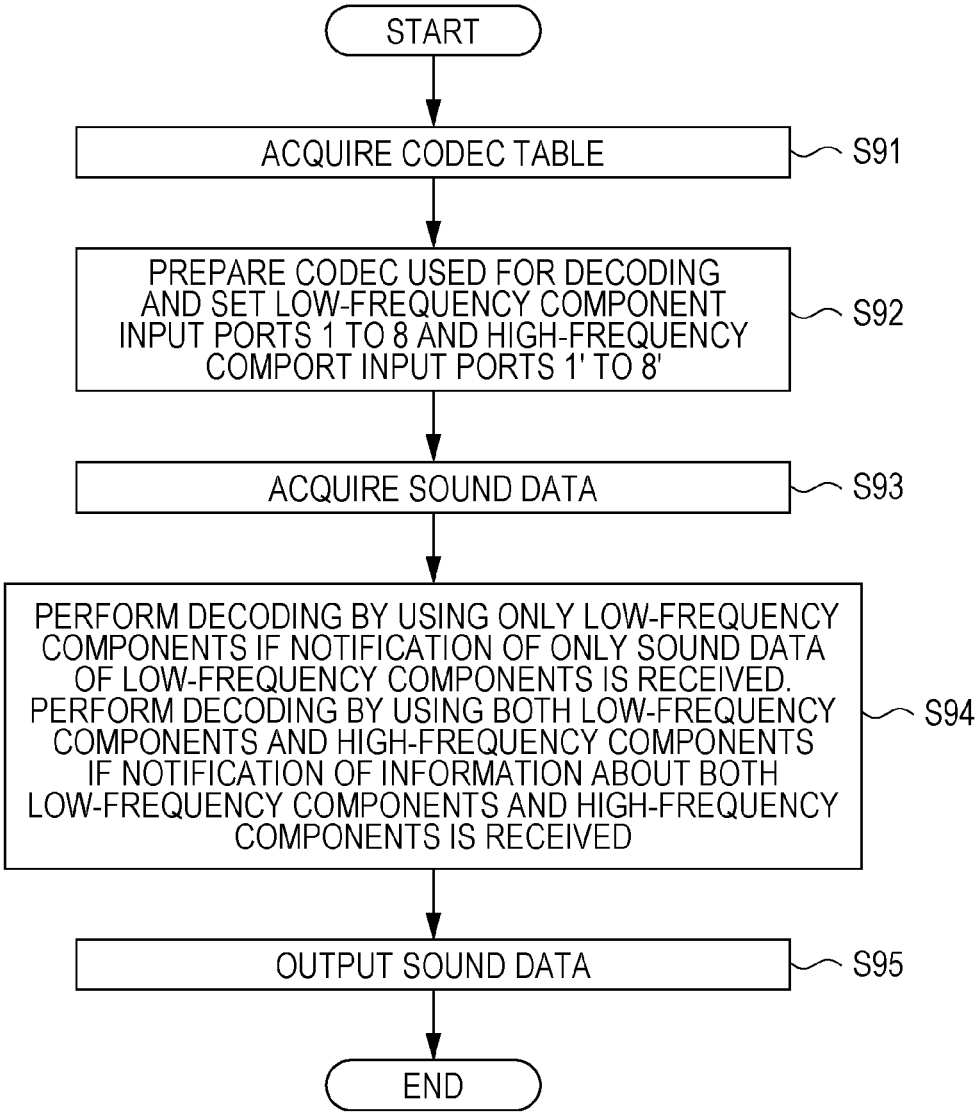
FIG. 17 is a flowchart illustrating an example of processing performed by a decoding unit in the reproducing apparatus in the third embodiment.

Example of Processing by the Decoding Unit 103 in the Reproducing Apparatus 91 in the Third Embodiment FIG. 17 is a flowchart illustrating an example of processing performed by a decoding unit in a reproducing apparatus in the third embodiment. In the example in FIG. 17, the decoding unit 103 acquires the codec table 73-1 (S91), after which the decoding unit 103 prepares codec used for decoding and sets low-frequency component input ports 1 to 8 and high-frequency comport input ports 1' to 8' (S92).

The decoding unit 103 then acquires sound data from the communication unit 102 (S93). If notified of only sound data of low-frequency components, the decoding unit 103 performs decoding by using only the low-frequency components. If notified of information about both low-frequency components and high-frequency components, the decoding unit 103 performs decoding by using both the low-frequency components and high-frequency components (S94).

The decoding unit 103 then outputs the decoded sound data to the sound image localizing unit 24 (S95). Thus, the sound image localizing unit 24 may compile the acquired sound data and may output, from the earphone 15, sound data on which a sound image having high-frequency components at the forward of the user has been localized.

In the third embodiment, as described above, since both the reproducing apparatus 91 and supply server 92 decide the forward, transmission of information as to what is the forward may be suppressed. Accordingly, it becomes possible to reduce the amount of communication and improve the communication efficiency.

Part or all of the first to third embodiments described above may be combined. The present disclosure is not limited to these embodiments. For example, instead of compressing and decompressing (decoding) sound data in which high-frequency components have been included, the supply server, for example, may transmit only sound data of low-frequency components and the positions of sound sources to the reproducing apparatus. The reproducing apparatus may use sounds of low-frequency components corresponding to the forward of the user to generate and compile sounds of high-frequency components. Then, perception of localization may be given to a sound image.

In these embodiments, as described above, appropriate sounds may be output. These embodiments achieve both maintenance of sound image localization and data compression in view of, for example, human characteristics and compression characteristics. In these embodiments, for example, sound data of high-frequency components is processed in correspondence to user's orientation information. In these embodiments, as described in the second and third embodiments, a virtual speaker for which its bandwidth is to be changed is switched by using the same bandwidth. In this case, communication is performed by including high-frequency components for sound sources present at the forward of the user. For the other directions (back), compressed sound data of low-frequency components is transferred. Therefore, appropriate sound communication may be performed in which both compression and sound quality are achieved.

In these embodiments, a sound around a certain point may be appropriately reproduced at another point with a reduced amount of communication so that perception of direction is included. Therefore, these embodiments may be applied to a system or the like that enables an auditor using an earphone, a headphone, or another ear-mounted reproducing apparatus to hear music and voice concerning an exhibit from a direction toward the exhibit or the like, the system being placed in, for example, a museum, an art museum, an exhibition, a theme park, or another location.

Embodiments have been described in detail, but the present disclosure is not limited to particular embodiments. Various modifications and changes are possible besides the above variations without departing from the scope of the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An information processing apparatus comprising:

a forward deciding unit that makes a decision as to a user's forward according to the user's orientation information;

a sound generating unit that creates sound data assigned to each of virtual sound sources placed in a plurality of directions preset in advance;

a compressing unit that performs compression on the created sound data by the sound generating unit in different ways between the created sound data corresponding to the user's forward obtained by the forward deciding unit and the created sound data corresponding to a direction other than the user's forward; and a communication unit that transmits the compressed sound data by the compressing unit.

2. The information processing apparatus according to claim 1, wherein the compressing unit performs compression on the created sound data corresponding to the user's forward so that a high-frequency component is restorable, and also performs compression on the created sound data corresponding to the direction other than the user's forward so that a low-frequency component is restorable.

3. The information processing apparatus according to claim 1, wherein the communication unit uses different communication paths to transmit the compressed sound data corresponding to the user's forward and the compressed sound data corresponding to the direction other than the user's forward, these compressed sound data items being obtained from the compressing unit.

4. The information processing apparatus according to claim 1, further comprising a sorting unit that sorts the created sound obtained from the sound generating unit data in correspondence to forward information obtained from the forward deciding unit, wherein the compressing unit performs the compression on each sorted sound data item sorted by the sorting unit in one of the different ways.

5. The information processing apparatus according to claim 1, further comprising an extracting unit, wherein:

the compressing unit separates the created sound data by the sound generating unit in correspondence to all virtual sound sources into a low-frequency component and a high-frequency component and compresses the created sound data of the low frequency component and the created sound data of the high-frequency component;

the extracting unit extracts the created sound data of the high frequency component that corresponds to the user's forward from the compressed sound data, obtained from the compressing unit, of the high-frequency component; and the communication unit transmits all compressed sound data of the low frequency component, the compressed sound data having been compressed by the compressing unit, and also transmits the compressed sound data of the high-frequency component, the extracted sound data by the extracting unit and corresponding to the user's forward.

6. The information processing apparatus according to claim 1, wherein the forward deciding unit selects at least one virtual sound source closest to the user's forward with reference to the user's orientation information and placement information in which a position of the virtual sound source has been set in advance.

7. The information processing apparatus according to claim 1, further comprising a control unit that controls coding information and a coding parameter that are used for compression of the created sound data corresponding to the user's forward obtained from the forward deciding unit and for compression of the created sound data corresponding to the direction other than the user's forward.

8. A sound processing method, performed by an information processing apparatus, comprising steps of:

making a decision as to a user's forward according to the user's orientation information, creating sound data assigned to each of virtual sound sources placed in a plurality of directions preset in advance, performing compression on the created sound data in different ways between the created sound data corresponding to the user's forward and the created sound data corresponding to a direction other than the user's forward, and transmitting the compressed sound data compressed in the different ways.

9. A non-transitory computer-readable storage medium in which a program has been recorded to cause a computer to make a decision as to a user's forward according to the user's orientation information, create sound data assigned to each of virtual sound sources placed in a plurality of directions preset in advance, perform compression on the created sound data in different ways between the created sound data corresponding to the user's forward and the created sound data corresponding to a direction other than the user's forward, and transmit the compressed sound data in the different ways.

* * * * *